US005207764A

United States Patent [19]

Akabane et al.

[11] Patent Number: 5,207,764

[45] Date of Patent: May 4, 1993

[54] TUMBLER TYPE WASHING/DRYING MACHINE

[75] Inventors: Tatuo Akabane, Tondabayashi; Susumu Kitamura, Kishiwada; Kazuhide Niinai, Osaka; Hiroaki Nagata, Yamatokoriyama; Yoshiaki Kajita, Kyoto; Koji Yamane, Kashiwara; Takeo Noguchi, Nara, all of Japan

[73] Assignee: Sharp Kabushiki Kaisha, Osaka, Japan

[21] Appl. No.: 775,542

[22] Filed: Oct. 15, 1991

[30] Foreign Application Priority Data

| | | | |
|---|---|---|---|
| Oct. 16, 1990 | [JP] | Japan | 2-278650 |
| Dec. 28, 1990 | [JP] | Japan | 2-415986 |
| Jan. 25, 1991 | [JP] | Japan | 3-47254 |
| Feb. 12, 1991 | [JP] | Japan | 3-18953 |
| Feb. 15, 1991 | [JP] | Japan | 3-22267 |
| Feb. 20, 1991 | [JP] | Japan | 3-26428 |
| Apr. 20, 1991 | [JP] | Japan | 3-88883 |
| Jun. 18, 1991 | [JP] | Japan | 3-145734 |
| Jun. 18, 1991 | [JP] | Japan | 3-159042 |
| Jul. 4, 1991 | [JP] | Japan | 3-164692 |
| Jul. 4, 1991 | [JP] | Japan | 3-164693 |
| Jul. 5, 1991 | [JP] | Japan | 3-165910 |
| Jul. 23, 1991 | [JP] | Japan | 3-182658 |
| Jul. 30, 1991 | [JP] | Japan | 3-190328 |
| Aug. 9, 1991 | [JP] | Japan | 3-200218 |

[51] Int. Cl.[5] ..... D06F 21/04

[52] U.S. Cl. ..... 68/20; 34/133 A; 34/133 P; 68/24; 68/58; 68/60

[58] Field of Search ..... 68/19.2, 20, 23.6, 24, 68/28, 58, 60; 34/133 A, 133 M, 133 P, 133 Q

[56] References Cited

U.S. PATENT DOCUMENTS

| | | | |
|---|---|---|---|
| 2,940,179 | 6/1960 | Czech | 34/133 Q X |
| 2,955,451 | 10/1960 | Delos | 68/24 X |
| 2,957,330 | 10/1960 | Cline | 68/20 |
| 3,006,176 | 10/1961 | Behrens | 68/19.2 X |
| 3,111,017 | 11/1963 | Searle | 68/24 X |
| 3,503,228 | 3/1970 | Lake | 68/28 X |

FOREIGN PATENT DOCUMENTS

| | | | |
|---|---|---|---|
| 230071 | 4/1959 | Australia | 68/20 |
| 390011 | 10/1990 | European Pat. Off. . | |
| 1144868 | 4/1957 | France | 68/58 |
| 129761 | 8/1979 | Japan . | |
| 55-78996 | 6/1980 | Japan . | |
| 152691 | 11/1981 | Japan . | |
| 158691 | 12/1981 | Japan . | |
| 69889 | 4/1982 | Japan . | |
| 794 | of 1983 | Japan . | |
| 58-12686 | 1/1983 | Japan . | |
| 61-21476 | 7/1986 | Japan . | |
| 126585 | 10/1990 | Japan . | |
| 2-71896 | 11/1990 | Japan . | |
| 2-77493 | 11/1990 | Japan . | |
| 2-77494 | 11/1990 | Japan . | |
| 57488 | 3/1991 | Japan . | |
| 34474 | 4/1991 | Japan . | |
| 972278 | 10/1964 | United Kingdom | 68/23.6 |
| 972280 | 10/1964 | United Kingdom | 68/28 |

*Primary Examiner*—Philip R. Coe

[57] ABSTRACT

A washing/drying machine including a washtub, a feeding device for feeding water to the washtub, a draining device for draining water from the washtub, a tumbling drum, rotatably supported by a lateral axis in the washtub, having a plurality of holes through which air and water pass and an opening for introducing the washing, and a lid for closing the opening, a motor for rotating the drum at various speeds, a disc for agitating the washing, disposed in the drum adjacent to a flat end wall of the drum in parallel with the wall, a bearing device for rotatably bearing the disc, a fixing device for selectively fixing the disc, a device for supplying hot air to the drum, and a controller for controlling the fixing device to intermittently fix the disc against the rotation of the drum, and a controlling method thereof.

15 Claims, 35 Drawing Sheets

50rpm

65rpm

70rpm

80rpm

90rpm
130rpm

FIG. 24

| CAPACITY | SPEED AND TIME OF REVOLUTIONS OF DRUM |
|---|---|
| SMALL | 50rpm→60→65→70→80→90→100→120→130rpm<br>5sec 5 5 5 5 5 5 5 20sec |
| MEDIUM | 50rpm→60→70→80→90→100→120→130rpm<br>5sec 5 7 7 5 5 5 20sec |
| LARGE | 50rpm→60→70→80→85→90→100→120→130rpm<br>5sec 5 5 5 8 8 8 8 20sec |

TUMBLER TYPE WASHING/DRYING MACHINE

FIELD OF THE INVENTION

The present invention relates to a tumbler type washing/drying machine and a method of controlling the same, and more specifically, it relates to a washing/drying machine which performs various process steps of keeping the washing in wash water, washing, rinsing, dehydrating (extracting water), and drying, and to a method of controlling the washing/drying machine.

DESCRIPTION OF THE RELATED ART

There is a conventionally well-known tumbler type washing/drying machine which performs a series of functions from washing to drying by horizontally rotating a drum containing the washing therein in a tub (e.g., see Japanese Unexamined Patent Publication Nos. 78996/1980 and 12686/1983). However, such a conventional washing/drying machine has disadvantages as follows:

(1) In the step of washing, washing for the washing is processed through the so-called tumbling operation in which the washing is drawn up by an inner wall of the drum and then tumbled down into the wash water. This performance brings about a poor washability, and it needs a washing time double as long as that of a pulsator type full automatic washing machine.

(2) In the step of dehydrating, the tub greatly vibrates due to precession or mutation with high-speed retation of the drum. Therefore, a concrete or iron balancer of about 20 kg must be attached to the tub to restrain the undesired vibration, with a result that the total weight of the machine is made large.

(3) In the step of drying, it is difficult to expose dry air uniformly to the washing all over, and therefore, the washing may partially remain undried, or excessive drying causes the cloth to be damaged easily.

SUMMARY OF THE INVENTION

The present invention provides a washing/drying machine which includes a tub, means for feeding water to the tub, means for draining water from the tub, a tumbling drum rotatably along a lateral axis in the tub, having a plurality of holes through which air and water pass and an opening for introducing the washing, and a lid for closing the opening, means for rotating the drum at various speeds, a disc for agitating the washing, disposed in the drum adjacent to a flat end wall of the drum in parallel with the wall, means for rotatably bearing the disc, means for selectively fixing the disc, means for supplying hot air to the drum and means for controlling the fixing means to intermittently fix the disc against the rotation of the drum.

Preferably, the disc bearing means includes a bearing for rotatably supporting an axis of the disc, and the fixing means includes a clutch for mechanically engaging/disengaging the axis of the disc with/from the tub.

The agitating disc may include a plurality of projections and a plurality of air holes.

Preferably, the drum has an annular rib in the periphery of its circular side wall.

Preferably, the hot air supplying means includes a duct located outside the tub, for communicating both flat end walls of the tub, a blower located in the duct for circulating the air in the tub through the duct, and a heater located at the outlet end of the duct.

Further, preferably, the heater is arched in shape and located on one of the end walls of the tub and above the axis of the drum.

The heater may be accommodated in an arched concavity provided on the side wall of the tub and covered with a cover.

The heater may also be accommodated in a heater case attached to the side wall of the tub.

Preferably, the hot air supplying means further includes cooling means for cooling the circulating air in the duct to dehumidify it.

The cooling means may include a U-shaped air duct.

The drum rotating means may be a DC brushless motor composed of a stator provided with a winding and a rotor including a permanent magnet.

Preferably, an ON-OFF duty ratio of the line voltage applied to the winding of the stator in the washing condition, such as water-extracting and the like, where the motor works at high speed, is made larger than an ON-OFF duty ratio of the line voltage applied to the winding of the stator in the washing condition, such as washing, rinsing and the like, where the motor works at low speed, for controlling the revolution of the motor in accordance with the washing conditions.

The line voltage applied to the winding of the stator of the motor may be subjected to pulse width modulation in order to control the motor speed in a range of the washing conditions.

The present invention provides a method of controlling a washing/drying machine, which includes a tub and a tumbling drum for containing the washing horizontally disposed rotatable in the tub, for performing the steps of washing, water-extracting, and drying, the water-extracting step comprising the steps of storing in advance in storing means a plurality of programs for increasing the rotating speed of the drum by stages with time, loosening the washing by rotating the drum forward and backward alternately, reading the programs corresponding to an amount of the washing contained in the drum from the storing means, rotating the drum in one direction in accordance with the program read out, for gradually pushing the washing against the inner walls of the drum by centrifugal force, detecting a degree of vibration of the tub while the drum is rotating and comparing it with a given or reference value, and rotating the drum at higher speed than a maximum limit rotating speed according to the program to extract water from the washing when the vibration of the tub is smaller than the reference value.

Preferably, when the vibration of the tub attains the reference value in the step of rotating the drum according to the program read out, the drum is rotated forward and backward alternately to loosen the washing after temporarily stopped, and then further rotated according to the same program.

The water-extracting step may further include the steps of feeding the drum with water and then rotating it forward and backward alternately and draining the water from the drum when the vibration of the tub attains the reference value even with a predetermined times of repetitive performance of rotating the drum according to the program after the loosening of the washing.

The present invention also provides a method of controlling a washing/drying machine, which includes a tub and a tumbling drum for containing the washing horizontally disposed rotatable in the tub, for performing the steps of washing, rinsing, water-extracting, and drying, the water-extracting step comprising the steps of storing in advance in storing means a plurality of programs for increasing the rotating speed of the drum by stages with time, loosening the washing by rotating the drum forward and backward alternately, reading the programs corresponding to an amount of the washing contained in the drum from the storing means, rotating the drum in one direction in accordance with the program read out, for gradually pushing the washing against the inner walls of the drum by centrifugal force in a well-balanced condition, rotating the drum at higher speed than the maximum limit rotating speed according to the program to extracting water from the washing, rotating the drum again forward and backward alternately to loosen the washing, rotating the drum in one direction according to the program, and rotating the drum at higher speed than the speed in the previous step to further extract water from the washing.

BRIEF DESCRIPTION OF THE DRAWINGS

FIG. 24 is a diagram for explaining the relations between the rotation speed of the drum and time for a well-balanced condition;

DETAILED DESCRIPTION OF THE PREFERRED EMBODIMENTS

Now, the present invention will be described in detail in conjunction with the preferred embodiments shown in the accompanying drawings.

1. Overall Structure of Washing/Drying Machine

Figure 1:
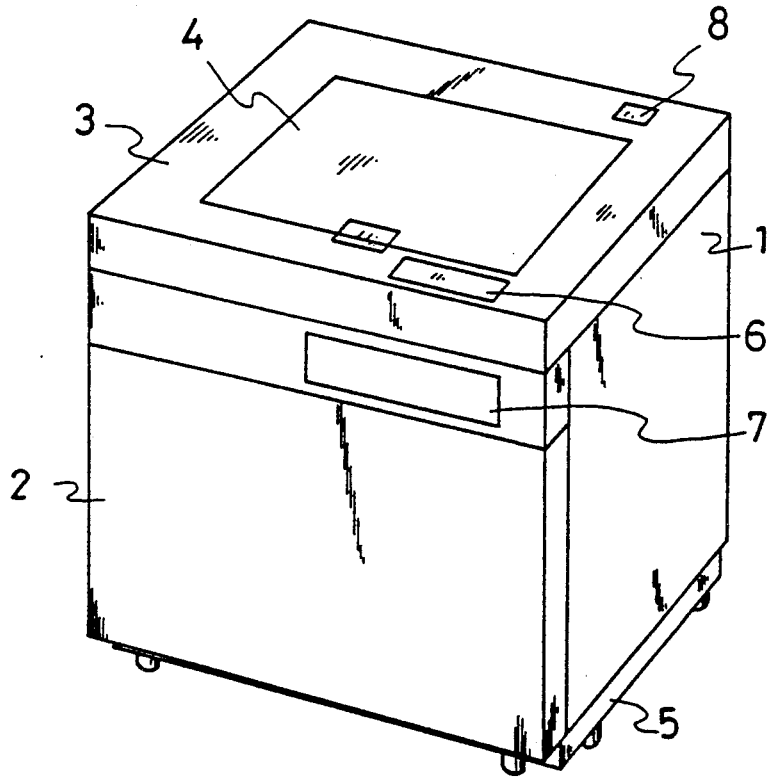
FIG. 1 is a perspective view showing a tumbler type washing/drying machine according to the present invention.
Figure 2:
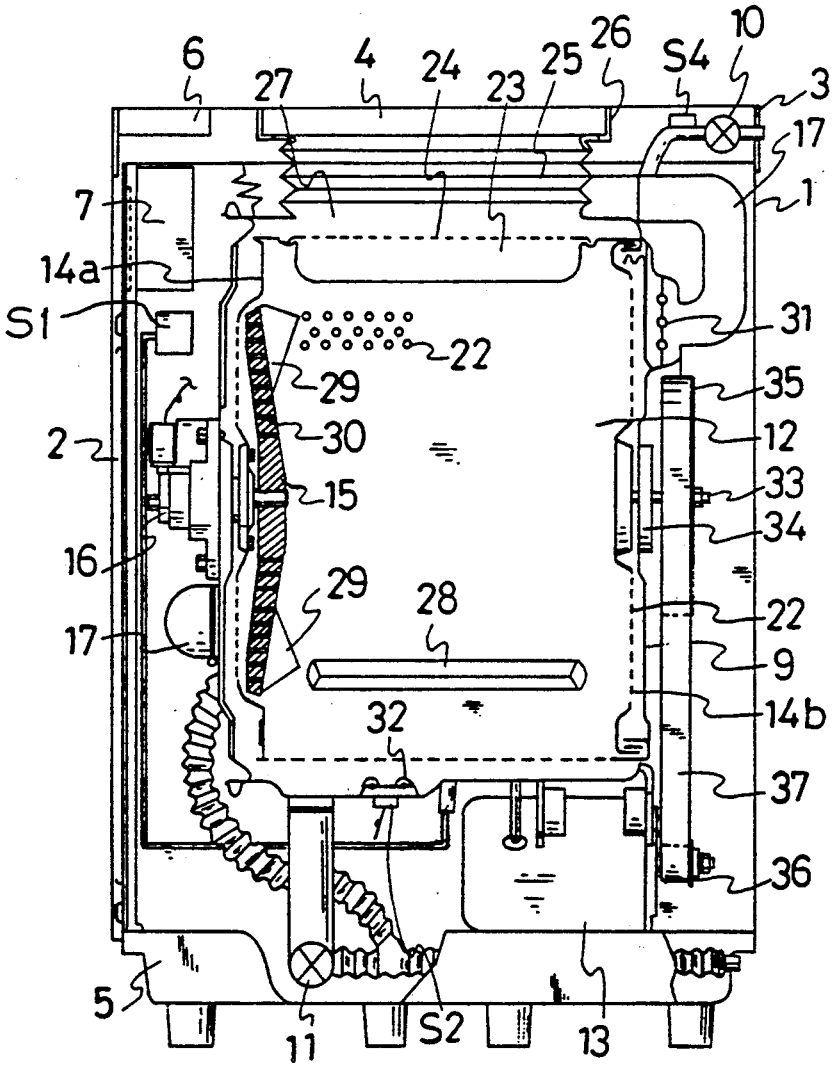
FIG. 2 is a vertical cross-sectional view showing the tumbler type washing/drying machine according to the present invention.
Figure 3:
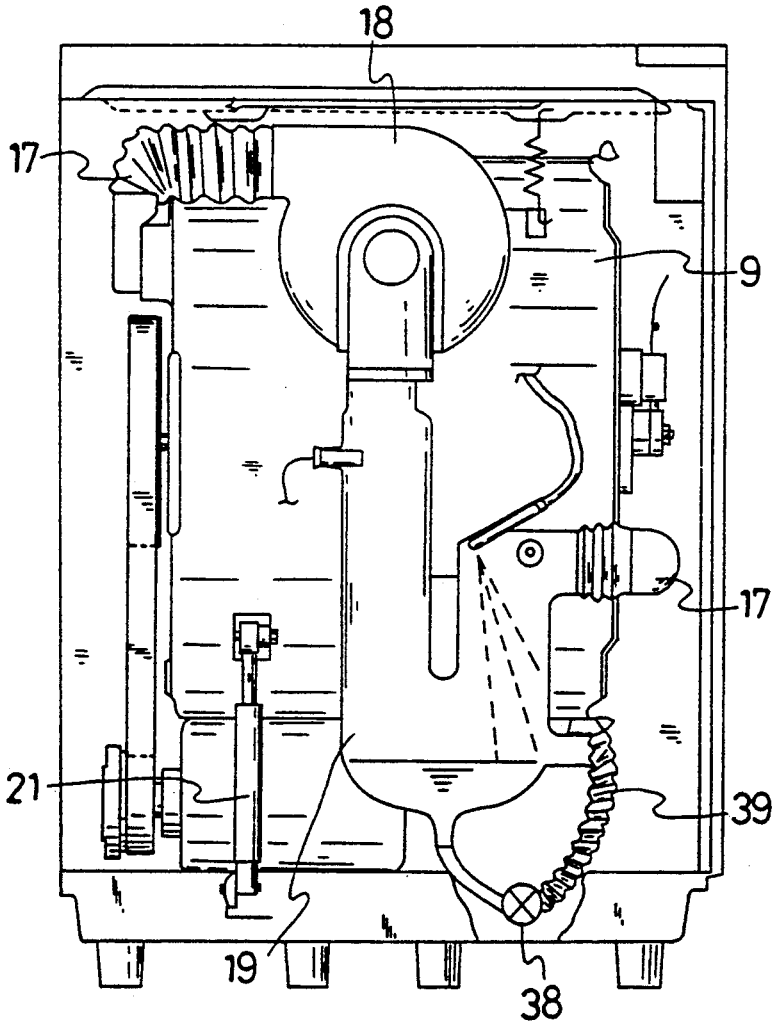
FIG. 3 is a side view showing the left side of the tumbler type washing/drying machine according to the present invention.
Figure 4:
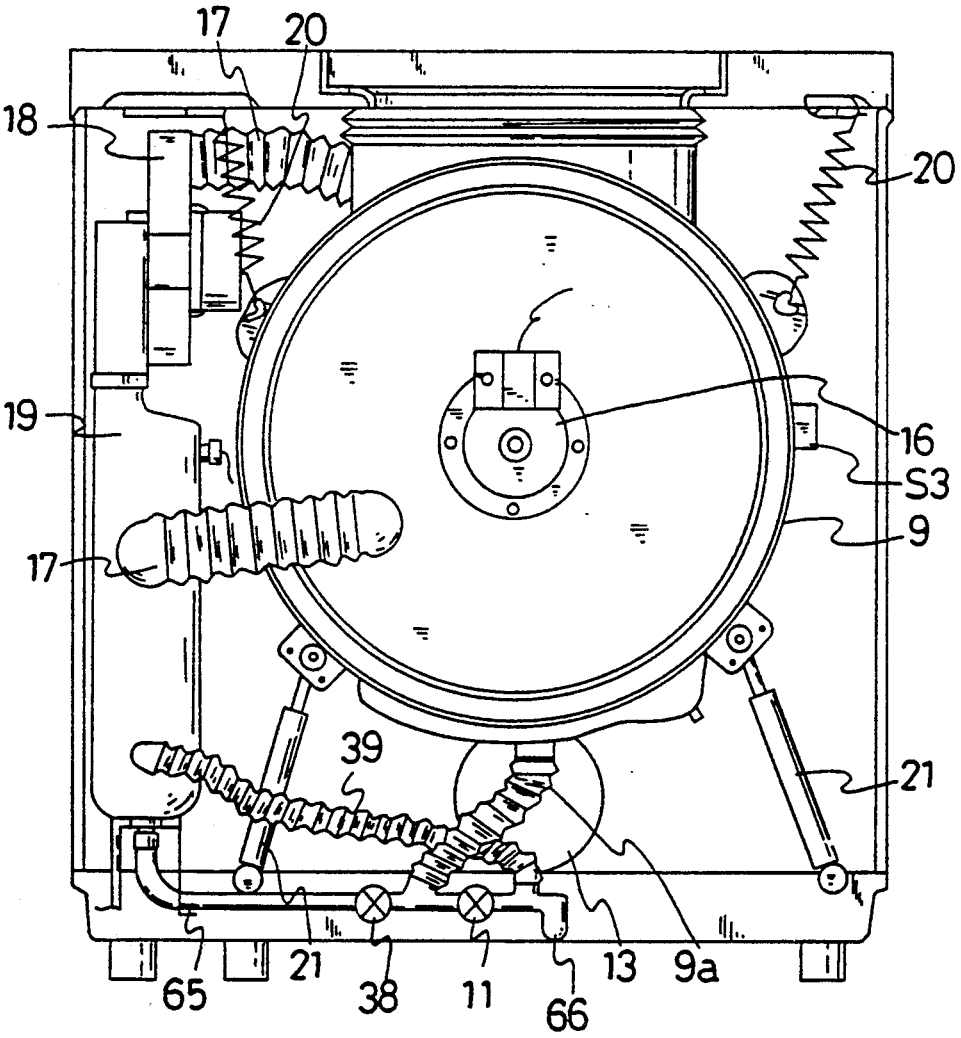
FIG. 4 is a frontal elevational view showing the tumbler type washing/drying machine according to the present invention.
Figure 5:
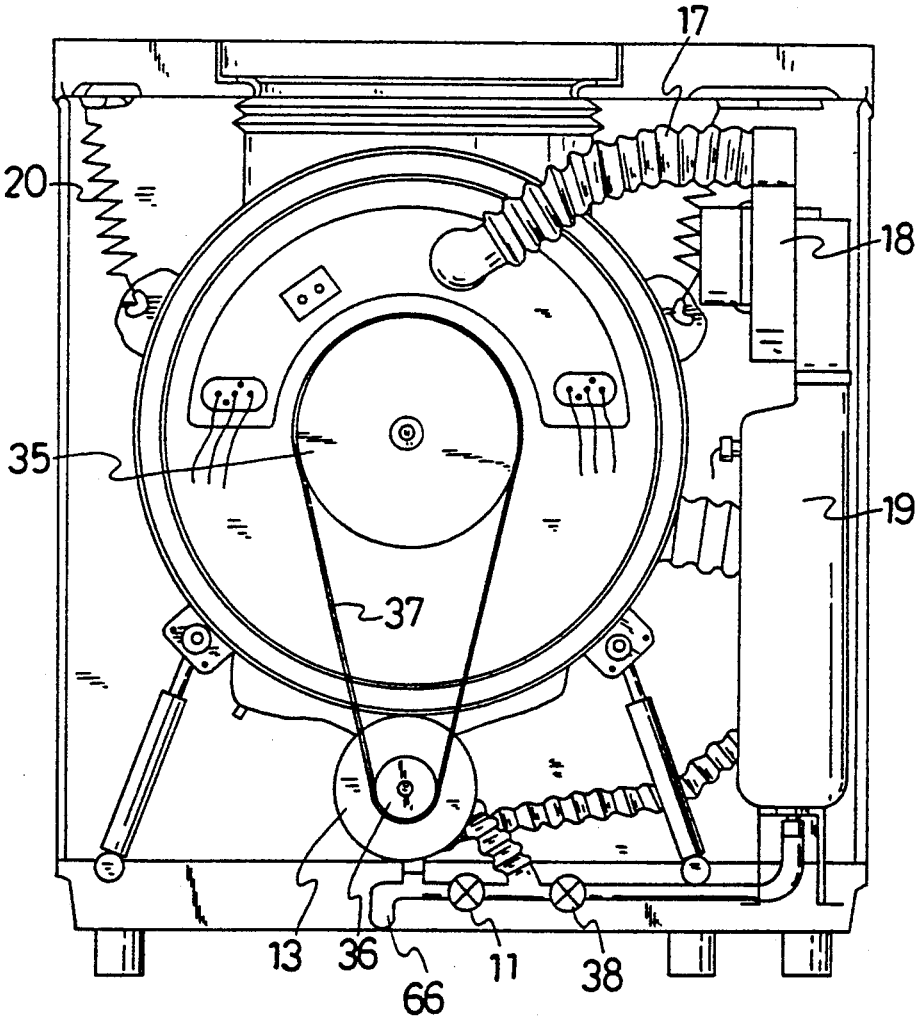
FIG. 5 is rear elevational view showing the tumbler type washing/drying machine according to the present invention.

FIG. 1 is a perspective view showing a washing/drying machine according to the present invention. Referring to FIG. 1, the washing/drying machine has a cabinet 1, a front panel 2, an upper plate 3, a lid 4, a bottom plate 5, a control panel 6 having various control keys, a program display 7 having a start button, and a power switch 8. FIG. 2 is a vertical cross sectional view showing the washing/drying machine in FIG. 1. FIG. 3 is a side view of the left side of the washing/drying machine, where an inner structure except a part of the cabinet is shown. FIG. 4 is a frontal elevational view showing an inner structure with the front panel removed. FIG. 5 is a rear elevational view showing an inner structure with the cabinet removed. As shown in FIGS. 2 to 5, in the cabinet 1, there are provided a washtub 9, a drain valve 11, a washing drum 12 horizontally and rotatably supported in the washtub 9, a DC brushless motor 13 rotating the drum 12 forward and backward and capable of varying its rotating speed, a agitator disc 15 inside and in parallel with a flat end wall 14*a* of the drum 12, an electromagnetic clutch 16 selectively bearing the agitator disc 15 in either a freely rotatable state or a fixed state, a duct 17 formed outside the washtub 9 for communicating between two different side walls of the washtub 9, a blower 18 provided in a passage between opposite ends of the duct 17 for circulating air in the washtub 9 through the duct 17, a dehumidifying heat exchanger 19 provided between the opposites ends of the duct 17 for dehumidifying the circulating air in the duct 17 by cooling, a spring hanger 20 for hanging the washtub 9 from the cabinet 1, and a shock absorber 21 for fixing the washtub 9 to the cabinet 1. The drum 12 has apertures 22 over its circular wall and side walls 14*a*, 14*b*, through which air and water pass, an opening 23 at the circular wall, through which the washing is introduced and drawn out, and a door 24 for the opening 23. An elastic tube 25 is provided in an upper portion of the cabinet 1, communicating an opening 26 closed by the lid 4 and an opening 27 at the top of the washtub 9 and serving as a guide for the washing introduced into the drum 12. A plurality of baffles 28 are attached at regular intervals in the circular inner wall of the drum 12 to catch the washing while the drum 12 is rotating. The agitator disc 15 has a plurality of projections 29 at regular intervals on its surface and has throughholes 30 all over to which air and water pass. A heater 31 is placed in a juncture of the duct 17 to the washtub 9 for heating air to be fed through the duct 17 to the washtub 9. A heater 32 is placed inside a bottom of the washtub 9 for heating wash water in the washtub 9. The drum 12 has one of rotation axes 33 held by a bearing 34 at the side wall of the washtub 9 with a pulley 35 fixed on its end. The pulley 35 is connected to a pulley 36 on an output shaft of the motor 13 by a belt 37, and is driven by the motor 13. The other rotation axis 40 of the drum 12 and a rotation axis of the agitator disc 15 are coaxially held inside the clutch 16. A closing valve 38 drains cooling water from the dehumidifying heat exchanger 19, while an overflow pipe 39 drains water overflowing from the dehumidifying heat exchanger 19.

A water level sensor S1 is connected to the bottom of the washtub 9 through a air tube for detecting a water level in the washtub (see FIG. 2). A water temperature sensor S2 (FIG. 2) is provided at the bottom of the washtub 9 for detecting the temperature of wash water reserved in the washtub 9. A vibration sensor S3 (FIG. 4) is a sensor having a limit switch which works when the vibration of the washtub 9 becomes a given limit value or over. A flow rate sensor S4 is provided close to a feed valve 10 for detecting an amount of water fed to the washtub 9.

2. Agitator Disc and Electromagnetic Clutch

The agitator disc 15 and electromagnetic clutch 16 will be explained in detail below.

Figure 6:
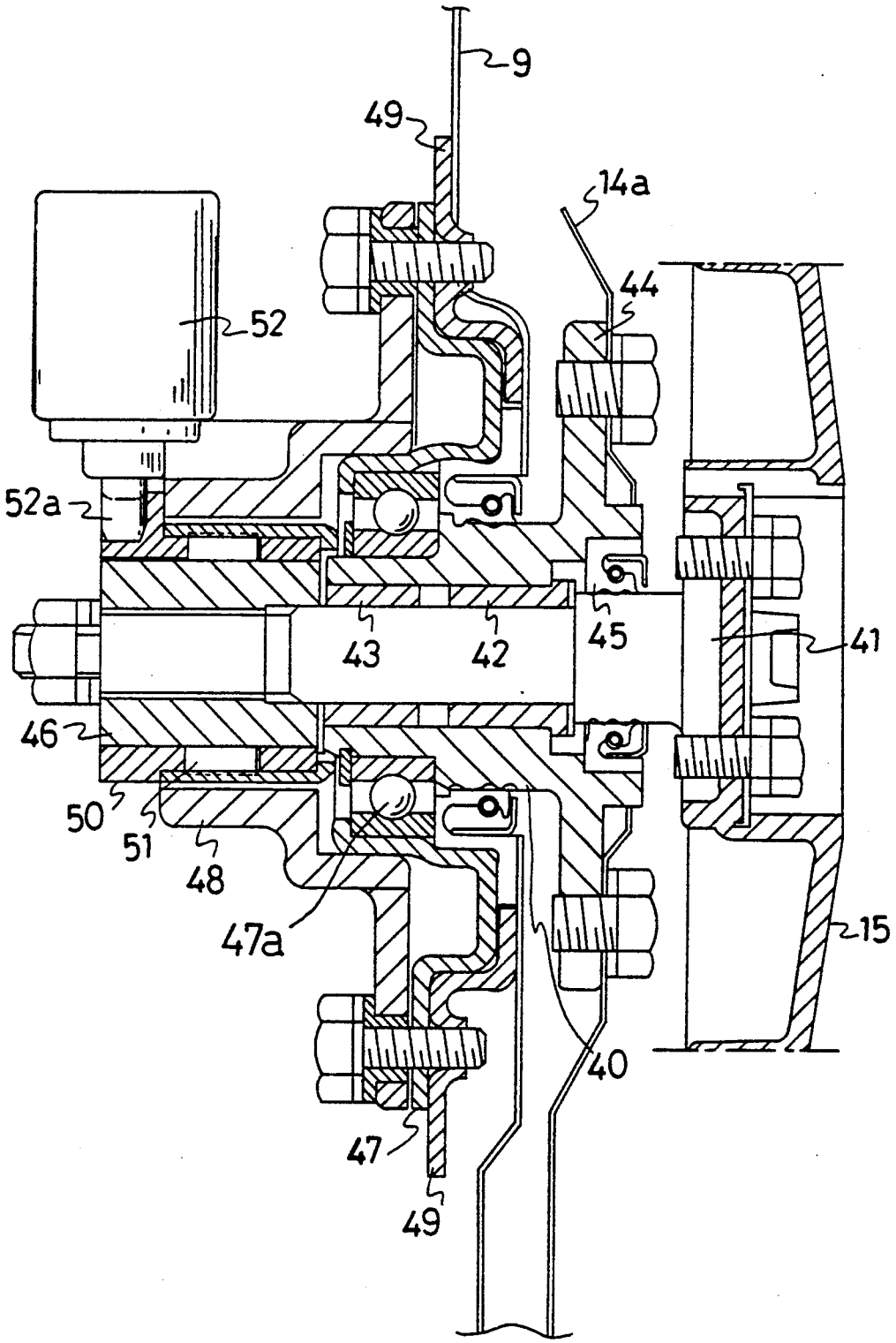
FIG. 6 is a sectional view showing a clutch.

As shown in FIG. 6, the rotation axis 40 of the drum 12 is a sleeve shaft, where an axis 41 of the disc 15 is borne by metal pieces 42, 43 so as to be able to rotate relative to the drum 12. The axis 40 has its flange 44 screwed on the end wall 14*a* of the drum 12. The axis 41 of the disc 15 has a seal 45 for sealing against wash water, and a clutch boss 46. A bearing holder 47 of a bearing 47*a* carrying the axis 40 is screwed on a bracked 49 together with a housing 48 extending up to the periphery of the clutch boss 46.

Figure 8:
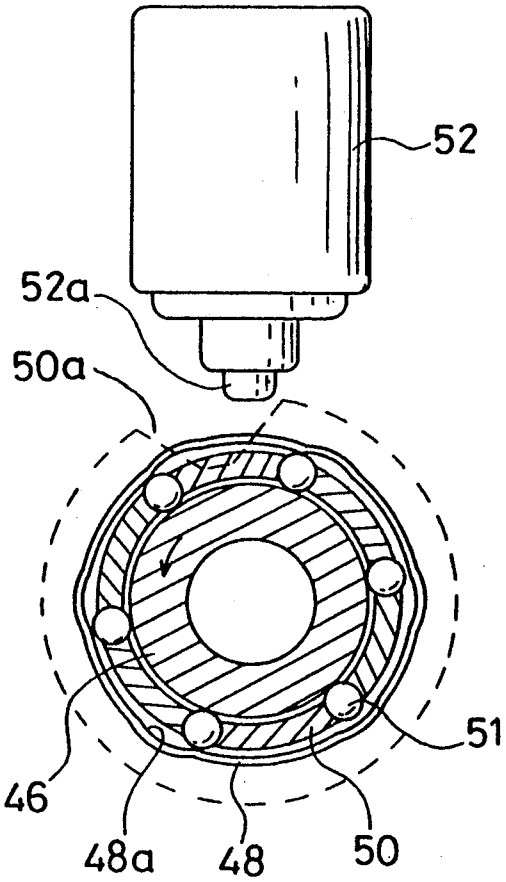
FIGS. 7 to 9 are partial sectional view showing the operation of a major portion of the clutch.
Figure 7:
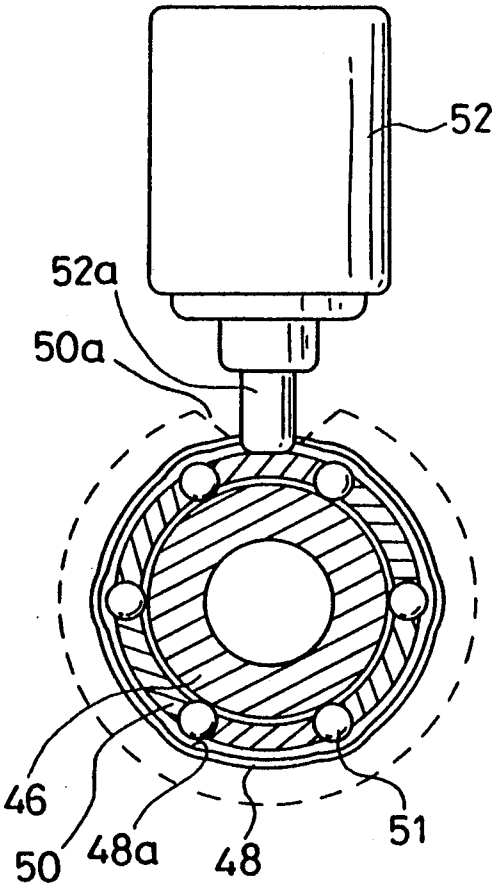
Figure 9:
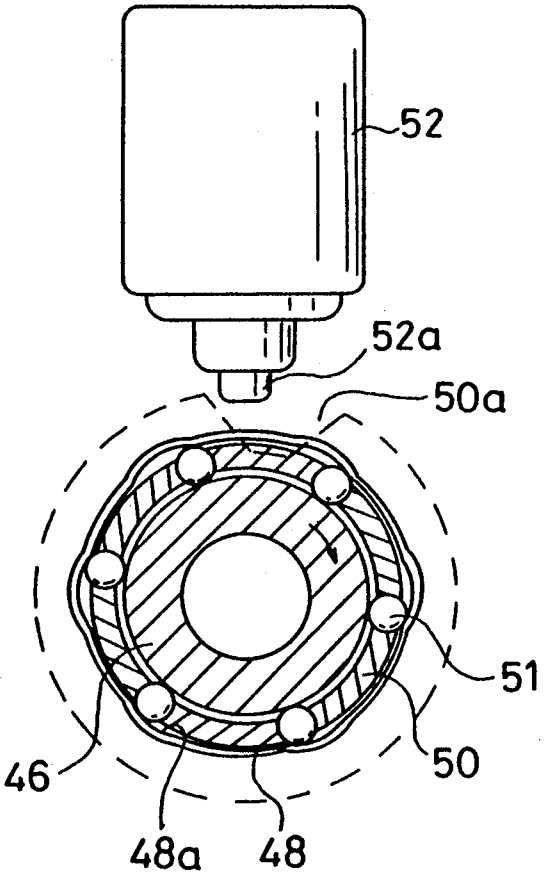

As shown in FIG. 7, the housing 48 has a plurality of concavities 48*a* positioned at regular intervals in its inner surface, and a retainer 50 is attached between the housing 48 and the clutch boss 46, while cylindrical rollers 51 are rotatably held between the concavities 48*a* and the clutch boss 46. The cylindrical rollers 51 are always pressed against the clutch boss 46 by a pressing element which is formed integral with or separate from the retainer 50. The retainer 50 has a groove 50*a* formed on its outer surface, in which a plunger 52*a* of a solenoid 52 is received so as to prevent the retainer 50 from moving. When the solenoid 52 is energized and the plunger 52*a* reaches the bottom of the groove 50*a*, the cylindrical rollers 51 are rotatably retained in the center of the concavities 48*a* by the retainer 50, and consequently, the agitator disc 15 is rotatably supported by the clutch boss 46 and the metal pieces 42, 43. When the energizing of the solenoid 52 is broken and the plunger 52 is pulled out of the groove 50*a*, that is, the clutch boss 46 tends to rotate, then the cylindrical rollers 51 are moved by contact of the rotating clutch boss 46 until they are stopped by a wedge action between the housing 48 and clutch boss 46; that is, as shown in FIG. 8 or 9, the cylindrical rollers 51 chock the clutch boss 46 up in the housing 48, and therefore, the disc 15 does not rotate even with the rotation of the drum 12.

Thus, the following effects are attained in the washing step where the drum 12 is rotated:

(1) When the solenoid 52 is turned off so that the disc 15 may be stationary in opposition to the drum 12 on rotating, the projections 29 on the agitator disc 15 act beating and rubbing to the washing, and additionally, the washing tumbles in the three-dimensional way in the drum 12 and jumbles with high efficiency, so that substantially the washing can be washed by friction and pressure caused by the rubbing and crumpling.

(2) When the solenoid 52 is turned on so that the disc 15 may freely move independently of the rotation of the drum 12, the disc 15 moves in accordance with the movement of the washing, so a simple movement of the washing is repeated in the drum 12, that is the washing hangs on the baffles 28, are lifted up and tumbles down. Thus, substantially the washing can be washed by the beating as in the conventional tumbler type washing machines.

The method mentioned in the above paragraph (1) significantly excels the method in (2) in washability. A combination of (1) and (2) attains a uniform washing of every part of the washing, and enables a wide range of regulation in washability.

3. Heater for Drying

The heater 31 is arched in shape, of which center corresponds to the axis of the drum, and located on one of the end walls of the washtub and above the axis of the drum, and its configuration will be explained in detail below.

Figure 11:
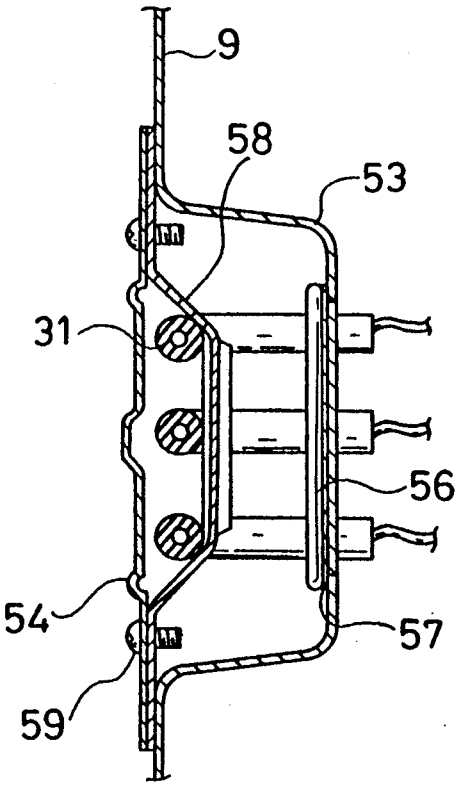
FIG. 11 is a sectional view showing a configuration of the fixing of a heater of the tumbler type washing/drying machine according to the present invention.

As shown in FIG. 11, an arched groove 53 is formed facing outside on the upper half of one the end walls of the washtub 9 by means of drawing and others. The arched groove 53 on the washtub 9 may alternatively be formed with a separate heater case fixed to the side wall of the washtub 9 by means of welding or the like. The heater 31 is attached inside the arched groove 53 of the washtub 9. The arched groove 53 having the heater 31 therein has its opening facing to the drum 12 covered with an arched heater cover 54. Air for the drying is heated by the heater 31 in an arched space defined by the arched groove 53 and heater cover 54.

Figure 10:
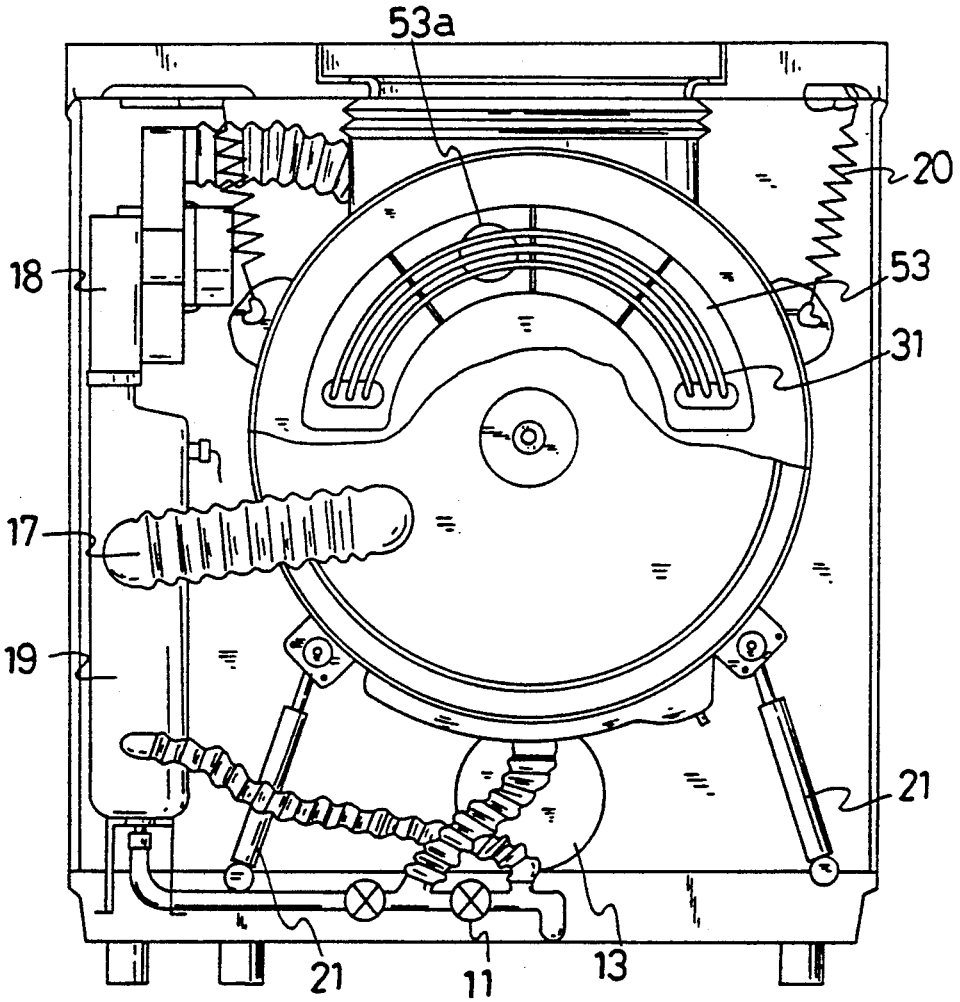
FIG. 10 is a partial cutaway view showing a major portion of the tumbler type washing/drying machine according to the present invention.
Figure 12:
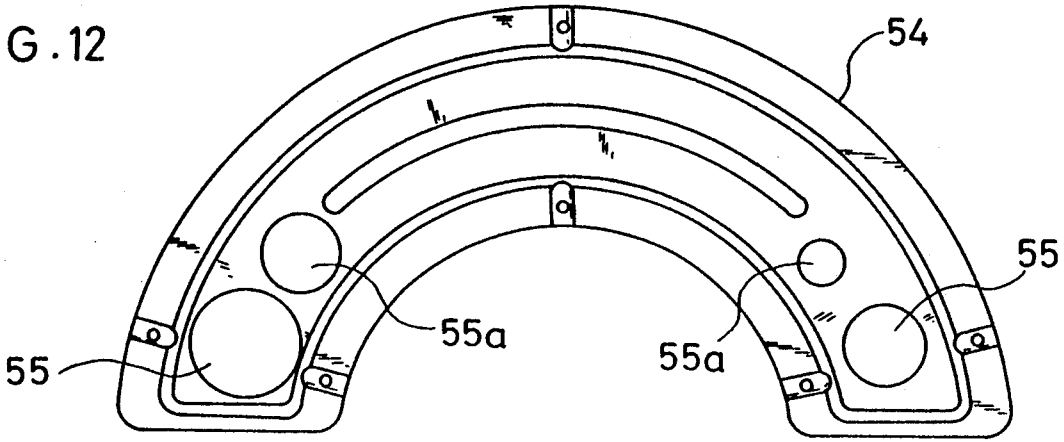
FIG. 12 is a frontal elevational view showing a heater cover.

The arched groove 53 has an inlet 53*a* (FIG. 10) of the air for the drying in its center, and the outlet 53*a* is connected to an exhaust outlet of the duct 17. The heater cover 54 has outlets 55, 55*a* of the air for the drying at its arched opposite ends (see FIG. 12). The air outlets 55*a* at the arched opposite ends may be formed one at each end, or more than one at each end (two at each end in FIG. 12).

The size of the air outlets 55, 55*a* at the arched opposite ends is determined so that an amount of air for the drying blown out of them may be the same. When two of the air outlets 55, 55*a* are provided at each of the arched opposite ends, the outlets 55 having a longer air path from the air inlet 53*a* in the arched groove 53 are larger than the outlets 55*a*; that is, all of the outlets exhaust the same amount of air as they can. The heater cover 54 is reinforced by forming a diaphragm, folds, ribs or the like and is adapted not so as to be warped because of an attachment to the washtub 9.

The washtub 9 also has an exhaust outlet of hot air in its lower half opposite the position where the arched groove 53 is formed, from which hot humid air after touching the wet washing should be extracted. The duct 17 connect the exhaust outlet to the dehumidifying heat exchanger 19.

Figure 13:
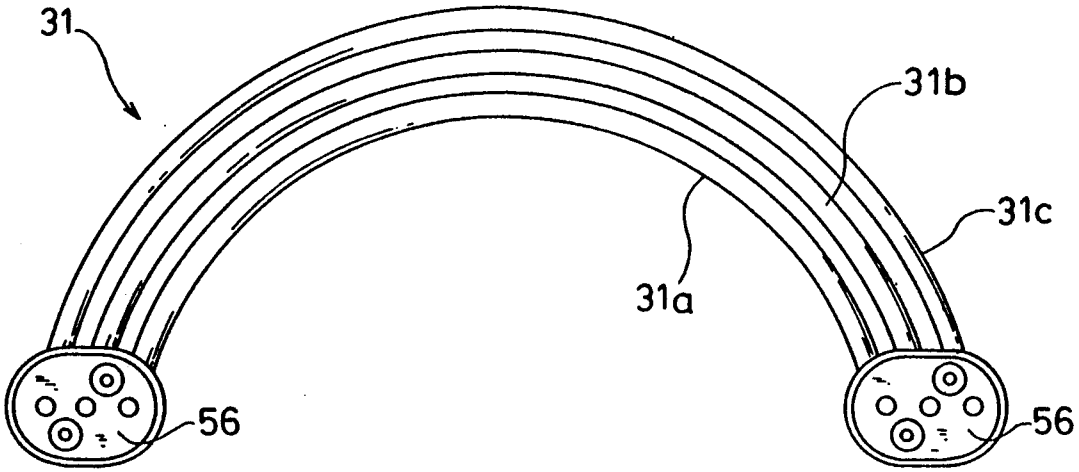
FIG. 13 is a frontal elevational view showing a configuration of the heater.

FIG. 13 is a diagram showing the heater 31, which is composed of arched heaters 31*a*, 31*b*, and 31*c* having their respective opposite ends fixed to heater flanges 56, and each of the heaters 31*a* to 31*c* is solely energized. The heater 31 is fixed to the arched groove 53 on the washtub 9 with packing 57 attached to the heater flanges 56. A plurality of heater supporting angles 58 are fixed to the arched groove 53 by spot welding, and the heater cover 54 is screwed on the heater supporting angles 58.

Air for the drying is fed through an arched path defined by the arched groove 53 on the washtub 9 and heater cover 54 into the drum 12 and traverses the drum 12 as an air flow passing through all over the washing. Therefore, the heated air for the drying dehumidifies the washing without causing a local increase in temperature and without remaining undried part, and thus, the washing can be dried with high drying efficiency. The temperature in the washtub 9 never rise near 100° C. unlike an ordinary tumbler type washing/drying machine, but reaches about 60° C. like a general cloth dryer.

Since the heater 31 is composed of a plurality of arched heaters each of which can be solely energized, a drying temperature for cloth of chemical fiber which must be dried at low temperature can be easily controlled in a considerably wide temperature range by changing a combination of the number of the heaters to be energized. For example, if the heater having the total electric power of 1200 W is composed of three arched heaters having 350 W, 400 W and 450 W, respectively, the heater can be regulated in seven levels in accordance with the combination of energizing the heaters.

4. Dehumidifying Heat Exchanger

Figure 14:
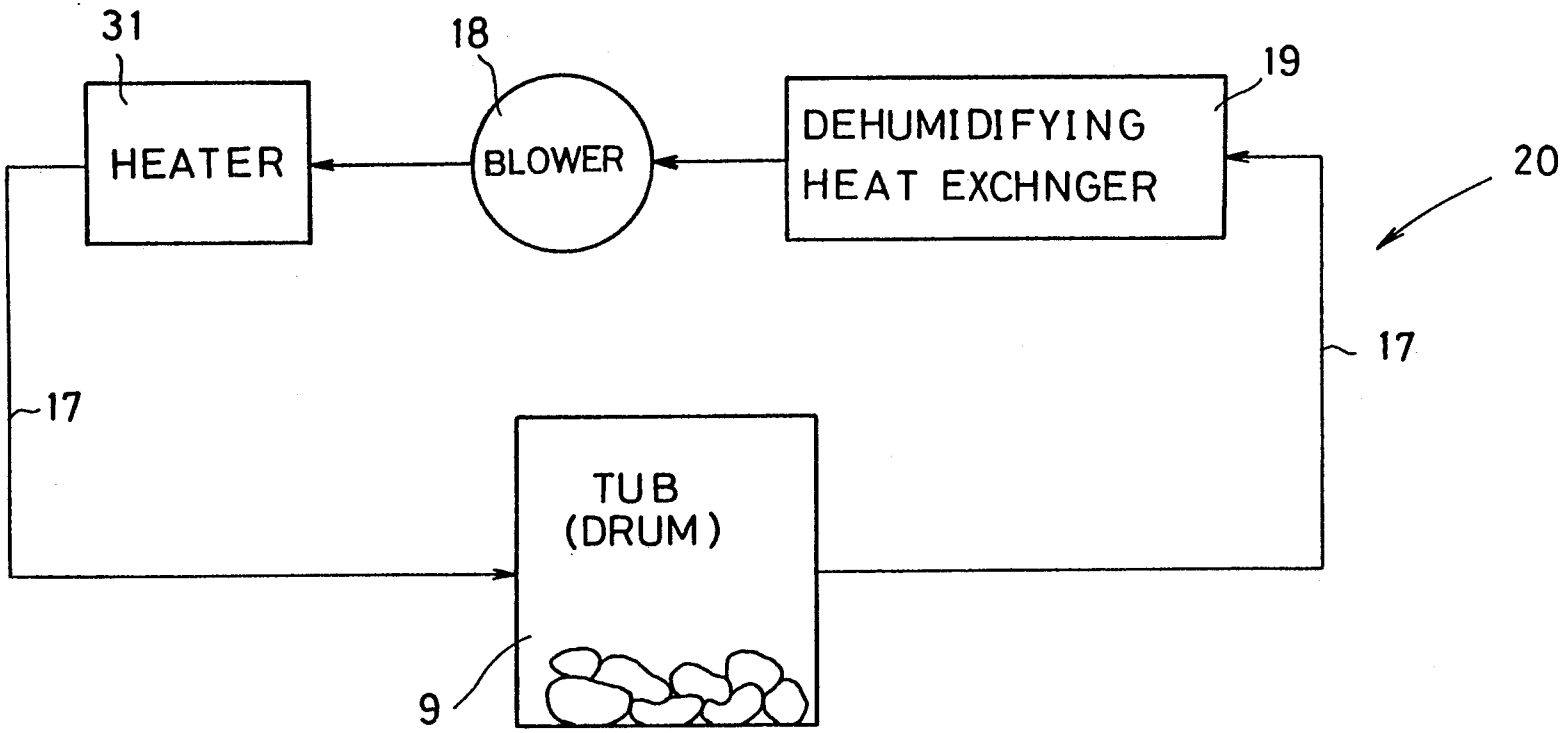
FIG. 14 is a diagram showing a circulating path of hot air.

Means for feeding hot air to the drum 12 in the drying step is provided outside the washtub 9, as shown in FIG. 14, and it is composed of the duct 17 for connecting one of the side walls of the washtub 9 to the other side wall, the blower 18 for circulating air in the washtub 9 through the duct 17, the heater 31 for heating air to be fed to the washtub 9, and the dehumidifying heat exchanger 19 for dehumidifying air to be exhausted from the washtub 9 by cooling.

The heat exchanger 19 is composed of a U-shaped air duct 60 connecting between a hot air exhaust outlet of the washtub 9 and an inlet of the blower 18, a cooling water spray nozzle 61 placed on the side of air inflow in the air duct 60, a drain outlet 62 formed at the bottom of the air duct 60, and the closing valve 38 (see FIG. 4) for opening and closing the drain outlet 62. To keep a fixed amount of water in the sharp bend 63 of the U-shaped air duct 60, an overflow outlet 64 is formed above the drain outlet 62 and below an wall above the bend 63.

The air duct 60 is positioned on the side of the washtub 9, placing the sharp bend 63 down, and it has a first end on the inlet side connected through the duct 17 to the hot air exhaust outlet of the washtub 9 while having a second end on the outlet side connected to the inlet of the blower 18 in a position higher than the first end. The hot air exhaust outlet of the washtub 9 is positioned at higher level than the level of wash water, serving also as an overflow outlet 64 of the washtub 9.

The cooling water spray nozzle 61 is attached to an upper surface of the first end on the inlet side of the air duct 60 and sprays water from a water supply device downward to have a large area as possible where the cooling water directly touches hot humid circulating air and consequently to take a good cooling effect. Thus, the dehumidifying capability can be enhanced, and additionally, the circulating air is reduced in temperature to prevent cloth from being damaged.

A drain pipe 65 is fitted on the drain outlet 62 and is connected through the closing valve 38 to the drain valve 11. A drain hose 66 (FIG. 4) is connected to the drain valve 11 to lead to the outside. A drain pipe 9 (FIG. 4) provided at the bottom of the washtub 9 is connected between the closing valve 27 and the drain valve 9 to prevent wash water from flowing into the heat exchanger 19 in washing.

Figure 15:
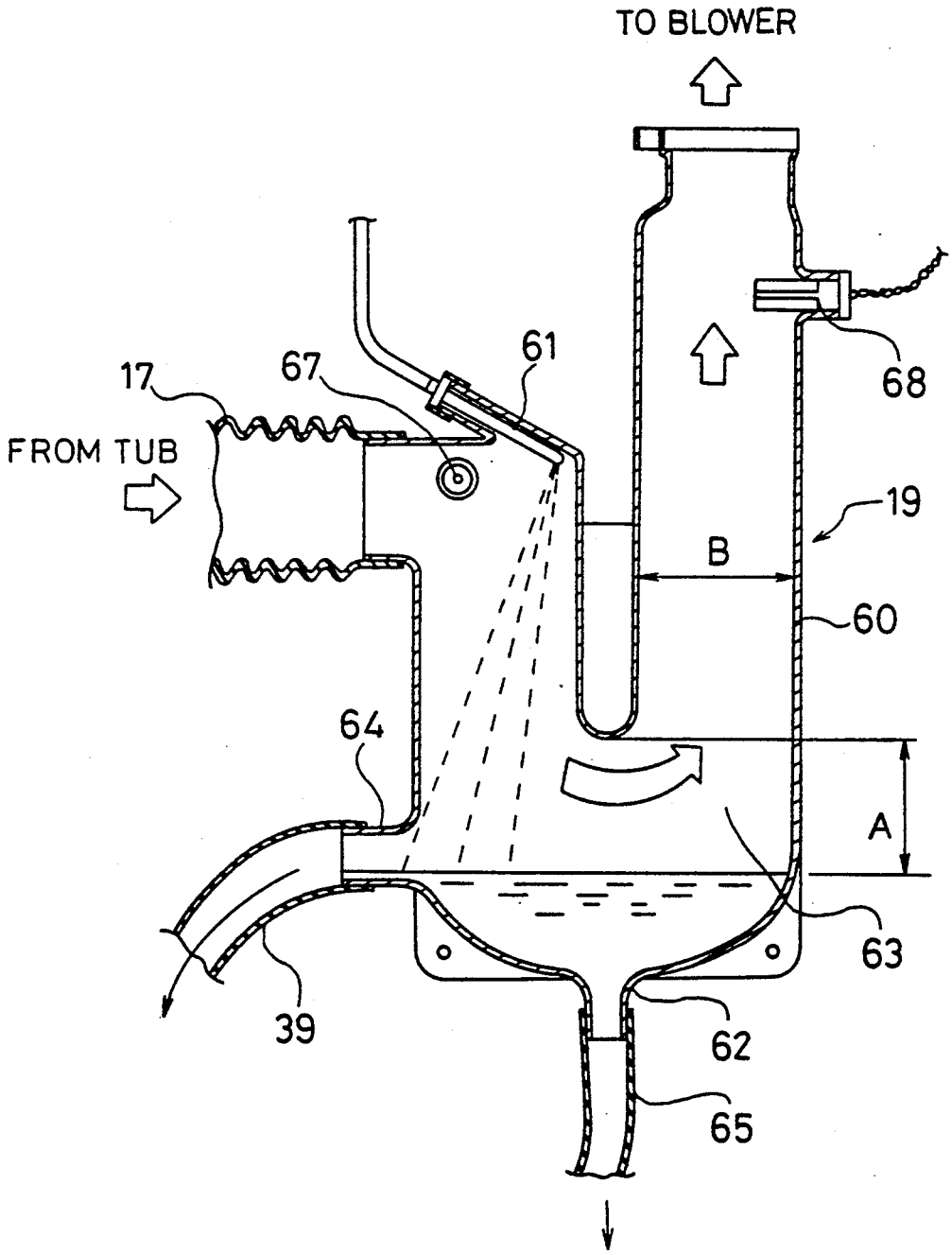
FIG. 15 is a sectional view showing a dehumidifying heat exchanger.

The overflow outlet 64 is settled in the position where an area of the water surface in the air duct 60 can be defined large and the air path for the circulating air does not narrow (i.e., there is no large difference between sectional areas taken along segments A and B in FIG. 15). The overflow pipe 39 has one end connected to the overflow outlet 64 and the other end connected to the drain hose 66 on the downstream side from the drain valve 11. The cooling water which has been heated at the end of the heat exchange is always drained out of the overflow outlet 64 no matter whether the machine is energized and further drained through the overflow pipe 39 out of the machine.

A sensor 67 is placed on the inlet side of the air duct 60 while a sensor 68 is placed on the outlet side; both the sensors 67, 68 are temperature sensors for detecting temperature of the circulating air.

The heat exchanger 19 can be provided with a humidity sensor for detecting a dehumidifying state and other devices beside the above-mentioned devices.

Now, a flow of the air for the drying and the cooling water in the drying step in the tumbler type washing/drying machine will be described. When the drying operation is started, the closing valve 38 is closed, while the heater 31, blower 18 and motor 13 are energized.

The circulating air which becomes hot and humid after drying the washing in the drum 12 pass through the duct 17 into the air duct 60, where it touches the cooling water sprayed by the cooling water spray nozzle 61 and further touches the surface of the cooling water kept in the lower part of the air duct 60. Then, the circulating air is condensed and releases humidity, and thereafter, it turns upward into the inlet of the blower 18. Then, the air is fed through the duct 17 to the washtub 9 and further to the heater 31, and is heated again.

The humidity cooled and condensed is drained together with the cooling water through the overflow outlet 64 and overflow pipe 39 out of the machine. In the drying operation, minute floating matter, lint, originated from the washing is also drained out of the washtub 9, and drops down in the water kept in the lower part of the air duct 60 along with the cooling water from the spray nozzle 61. The closing valve 38 is intermittently opened and closed, and accordingly, the water with the lint is drained. The closing valve 38 keeps closed for the most time except the time when the lint is drained with water, and therefore, the cooling water reaches the level of the overflow outlet 64, and the water over the water level is to be drained.

In the drying step, the sensors 67, 68 detect the temperature of the circulating air, and the drying operation is stopped when a difference between the temperatures detected by the temperature sensor 67, 68 is more than the given value.

Positioning the junction between the duct 17 at the inlet of the air duct 60 and the hot air exhaust outlet of the washtub 9 at a higher level than the surface of the rinsing water and at a lower level of the opening 27 for introducing the washing, the water can be drained through the heat exchanger 19 and overflow outlet 64 out of the machine when an abnormal rising of the water level is caused by water level sensor trouble or the like.

During the drying operation, the closing valve 38 keeps closed except the time when it is intermittently opened for a short time. The closing valve 38 may be closed after the operation is ended, but it can be manually opened if it is not used for a long time or if the water in it may possibly be frozen in winter.

The heat exchanger 19 can have the hot air circulating path taking a large sectional area according to the abovementioned configuration. As a result, it can ensures a flow rate of the circulating air by making a pressure loss small, and can take a large contact area of the cooling water with the hot humid air.

In this way, the circulating air sufficiently touches the cloths in the drum 12 and the cooling water. Thus, the drying capability can be improved, and the temperature of the circulating air can remain low.

Making a water pool in the air duct 60, the water surface of the pool can be useful for heat exchange. Thus, a small amount of cooling water is effectively utilized to enhance the dehumidifying capability and to further improve the drying capability. Additionally, in this case, the hot air is directed almost orthogonal to the water surface, and therefore, minute lint in the hot air can be eliminated.

In this way, since almost all lint can be eliminated in the heat exchanger, there is no need of using a special filter and the like and no need of the frequent inspection.

Figure 16:
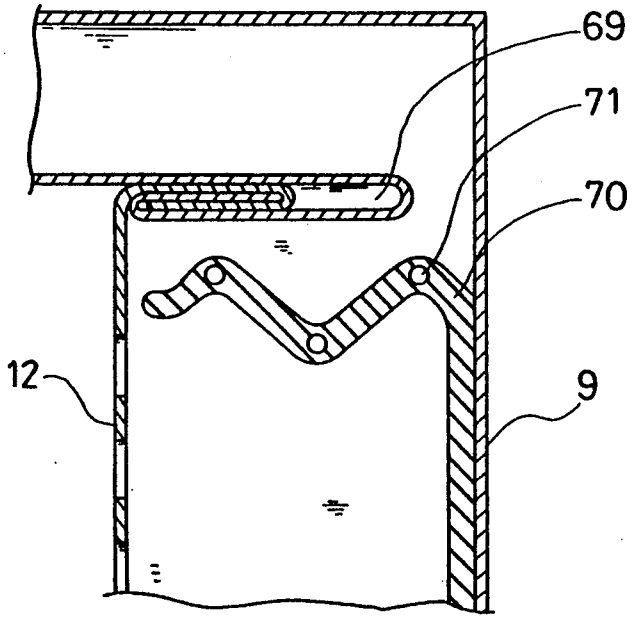
FIG. 16 is a sectional view showing a major portion of an annular rim.

The hot air feeding means composed of the heater 31, dehumidifying heat exchanger 19, blower 18 and duct 17, as previously mentioned, supplies hot air to the washtub 9, and especially, the hot air feeding means is designed so that the hot air can be effectively supplied to the washing in the drum 12 in the washtub 9. As shown in FIG. 16, the drum 12 has an annular rim 69 horizontally projecting on the whole periphery of its wall opposite to the heater 31. The rim 69 is integrally formed with the peripheral wall of the drum 12. A projecting length of the rim 69 is about 80% of an interval between the circular side wall of the drum 12 and the side wall of the washtub 9.

An annular guide 70 projecting toward the drum 12 is attached to the inner surface of the side wall of the washtub 9. The guide 70 is of rubber, and it is composed of a part in contact with the inner surface of the side wall of the washtub 9 and a part projecting contiguous to the previous part, as shown in FIG. 2. The guide 70 has a shape of bellows having the whole inner circular surface of the projecting part wound by reinforcing wire 71 in spiral. The guide 70 has a smaller diameter than the rim 69. The projecting part of the guide 70 has a length of about 95% of an interval between the side wall of the washtub 9 and the circular side wall of the drum 12.

When the hot air heated by the heater 31 is supplied to the washtub 9, the guide 70 on the washtub 9 and the rim 69 of the drum 12 prevent almost all the hot air from flowing toward the circular side wall of the drum 12, but guide the hot air to the throughholes on the side walls of the drum 12 so that the hot air may effectively blow into the drum 12.

5. Control Device of the Washing/Drying Machine

Figure 17:
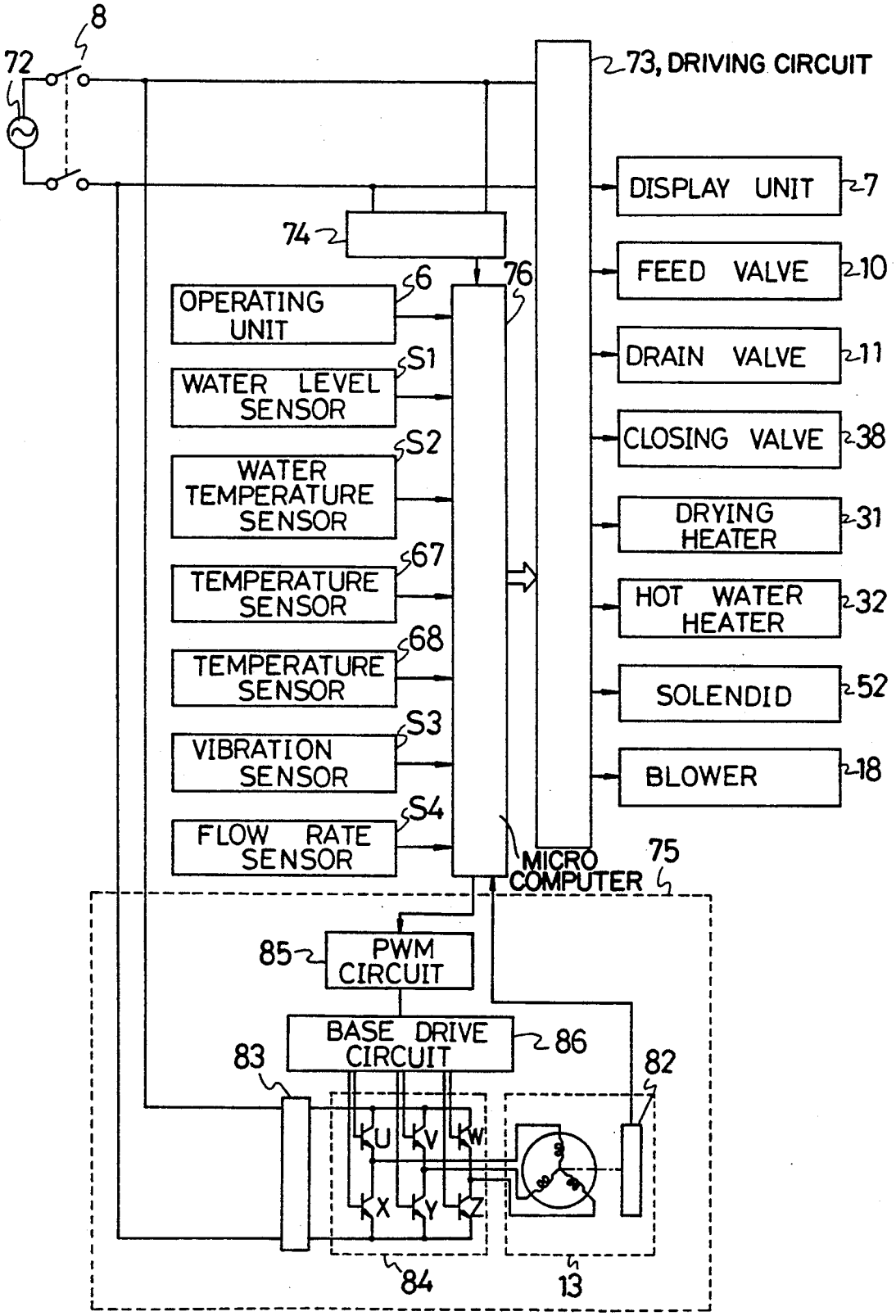
FIG. 17 is a block diagram showing a control device of the tumbler type washing/drying machine according to the present invention.

A major portion of a control device of the washing/drying machine is accommodated in an operating unit 6 and a display unit 7 shown in FIG. 2, and its structure is shown in a block diagram of FIG. 17. Referring to FIG. 17, voltage from an A.C. power source is applied through the power switch 8 to a driving circuit 73, a rectifying circuit 74 and a motor control circuit 75 for controlling the brushless motor 13. A microcomputer 76 starts when receiving D.C. voltage from the rectifying circuit 74. The microcomputer 76 receives output from the control unit 6, water level sensor S1, water temperature sensor S2, temperature sensors 67, 68, vibration sensor S3, flow rate sensor S4 and motor control circuit 75 to output a signal for controlling the program display 7, feed valve 10, drain valve 11, closing valve 38, heater 31, hot water heater, solenoid 52 and blower 18 to the driving circuit 73 and output a signal for controlling the brushless motor 13 to the motor control circuit 75.

6. Motor Control for Controlling Revolving Speed of Drum

As previously mentioned, the drum 12 is driven by the revolving force transmitted from the DC brushless motor 13 through the pulley 36 and belt 37 to the pulley 35.

The motor 13 requires a large torque to lift up the washing soaked with wash water in washing and requires high speed revolutions in water-extracting. More specifically, the motor 13 must implement a large torque (about 38 kg.cm) and a low speed (about 400 rpm), and a low torque (about 2.5 kg.cm) and a high speed (about 8000 rpm).

Figure 18:
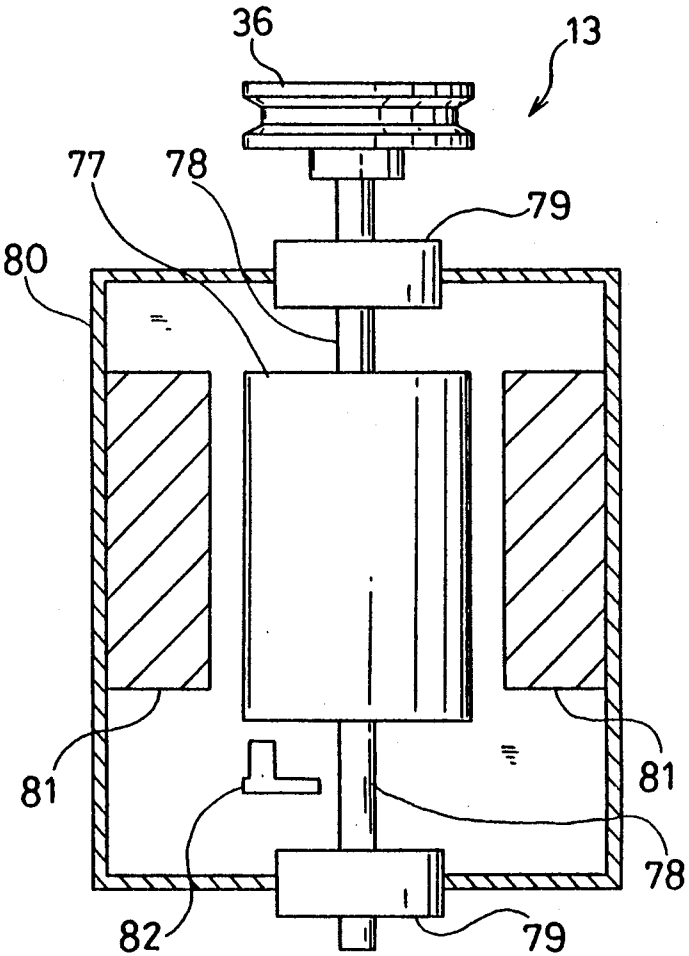
FIG. 18 is a sectional view showing a motor for rotating a tumbling drum.

The structure of the motor 13 will be described with reference to FIG. 18.

A permanent magnet 77 of a rotor 78 is made of ferrite and has a ring-like shape, having eight magnetic poles. The rotor 78 is borne by the bearing 79 and fixed to the motor case 80 in freely revolving condition, while a stator 81 is wound by winding so as to make three phases and fixed to the motor case 80.

The D.C. voltage produced from supply voltage of the power supply 72 by the rectifying circuit 83 is distributed in a transistor module 84 to drive the motor 13 in three-phase.

The revolution angle position of a rotor of the motor 13 is detected by three hole sensors 82 and applied to the microcomputer 76, which performs arithmetic operations therein to output base control signals of the transistor module 84 of the three phases. The signals are subjected to pulse width modulation in a PWM circuit 85 for controlling the number of revolutions and amplified in a base drive circuit 86, and thereafter, turn the transistor module 84 on.

Now, with reference to FIG. 19, a timing chart for producing the base signal of each phase of the transistor module 84 in accordance with a rotor position signal by the arithmetic operations performed in the microcomputer 76 will be described. In this embodiment, the ON-OFF duty ratio of a line voltage pattern applied to the winding of the stator of the motor is one third in the low speed operation but one half in the high speed operation.

The rotor position signal is detected at each pole of the permanent magnet 77 (for example, there are eight poles in this embodiment, so one cycle corresponds to 90°) by the three hole sensors 82 settled in predetermined positions of the motor 13. Three rotor position signals from the three hole sensors 82 are designated by (1), (2) and (3), respectively.

The base control signal varying with the revolution of the rotor in the counter clockwise direction (CCW) in the low speed operation (indicated by solid line), if it is a U-phase signal, is turned ON when the rotor position signal (1) falls, and is turned OFF as the rotor is retained at an angle 30°. In this way, the total ON-OFF duty ratio becomes $\frac{1}{3}$. Similarly, V- and W-phase outputs are controlled with reference to the falling of the rotor position signals (2) and (3).

X-, Y- and Z-phase outputs are controlled with reference to the rising of the rotor position signals (1), (2) and (3).

For a ON- time with the rotor angle of 30, if the U-phase signal is employed as an example, the rising of the rotor position signal (2) is detected and some processing is performed to turn it off.

In the high speed operation (indicated by broken lines), the signal output is controlled to turn on a rotor angle 15° earlier than the case in the low speed operation, and thus the total ON-OFF duty ratio becomes $\frac{1}{2}$. Practically, employing the U-phase signal as an example, the rising of the rotor position signal 2 is the reference.

While the base signal varying with the revolution of the rotor the clockwise direction (CW) is being turned on, the reference of the falling of the signal varying with the revolution of the rotor in the CCW direction becomes the reference of the rising. The order of the turning-off time of the U-, V- and W-phases and the X-, Y- and Z-phases is reversed; if the references of the rising and falling are reversed, the result is shown in FIG. 19, where a motor characteristic similar to the signal varying in the CCW direction can be observed.

Figure 29:
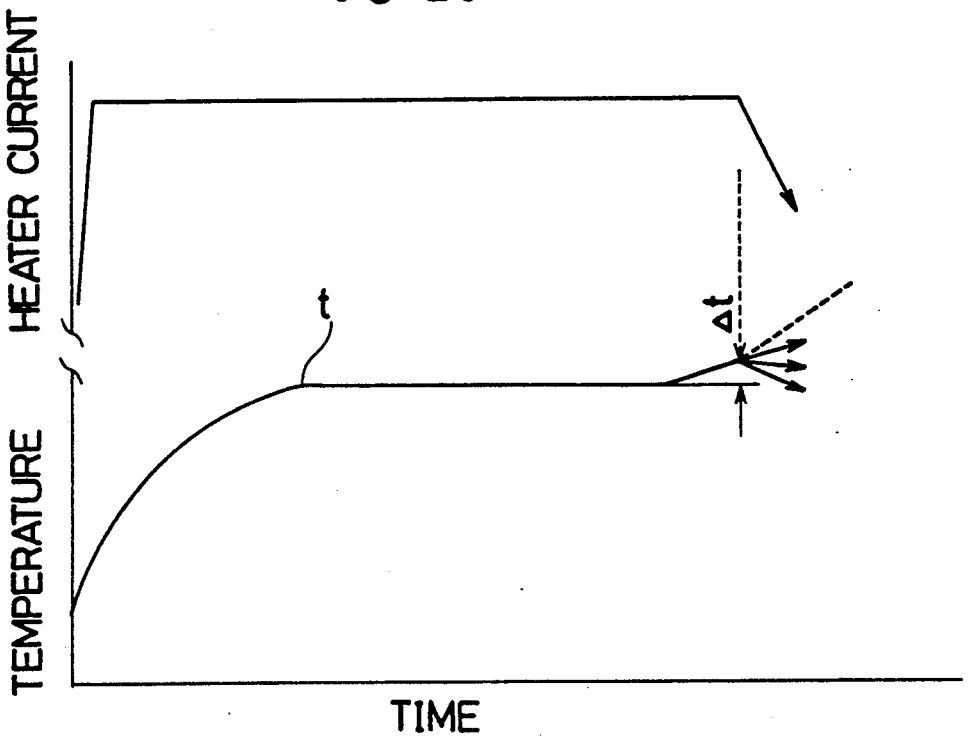
FIGS. 29 and 30 are graphs showing a curve of the heater current related to the temperature variation with time in the step of drying.

Then, the motor measured characteristic when the motor works in accordance with the timing chart in FIG. 19 will be explained with reference to FIG. 20. In FIG. 29, points A and B are operating points for the tumbler type washing/drying machine according to the present invention. Solid line expresses a control characteristic in the low speed operation, while broken line expresses it in the high speed operation.

Figure 20:
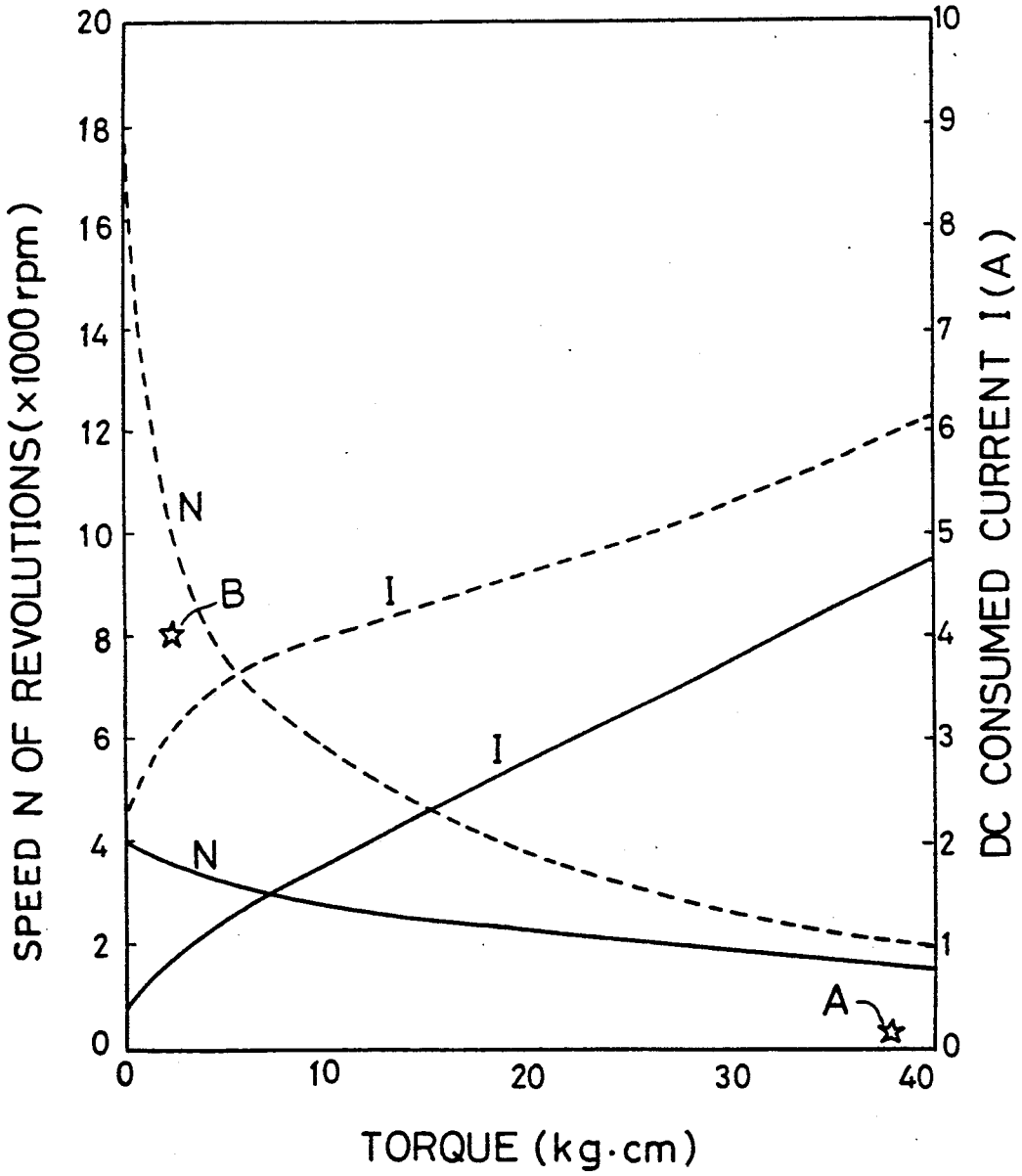
FIG. 20 is a diagram showing characteristic curves of the torque-revolution speed of the motor.

Referring to FIG. 20, it is apparent that the method of controlling in the high speed operation satisfies the requirement for both the operating points. However, the operating point A of the washing is an operating point for the case where the drum just starts or the clothes are entangled with each other, and it attains 400 rpm, one third or below of the maximum torque in practical operation. This method has the disadvantage that the motor must be large-sized because if the control method is applied not to the low speed operation which needs small consumed current but to the high speed operation which needs large consumed current, heat generated by the motor is too large.

Although the generation of heat can be inhibited with a permanent magnet of rare earth elements or the like because magnetic force becomes stronger, such a magnet of rare earth elements about twenty times as much in price as a ferrite magnet, and it is difficult to employing the magnet of rare earth elements for electric appliances.

Unlike the washing operation, a load torque does not vary once the drum starts revolutions at the point B in accordance with the method of controlling the high speed operation. A torque the motor requires corresponds to an amount of friction of a revolving mechanism when the accelerating period for revolutions ends, so consumed current is small even with the ON-OFF duty ratio of $\frac{1}{2}$, and there is no possibility that the motor generates heat.

This is why a cheap magnet having low magnetic force allows the motor to attain from a great torque at low speed to high speed revolutions without speed changing means.

Figure 21A:
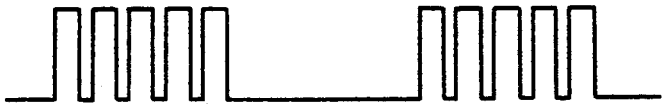
FIGS. 21(*a*) and 21(*b*) are wave form charts of PWM voltage applied to the motor.
Figure 21B:
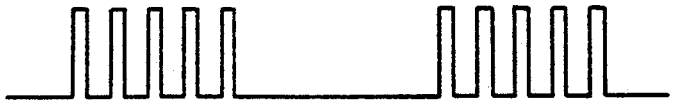
Figure 22:
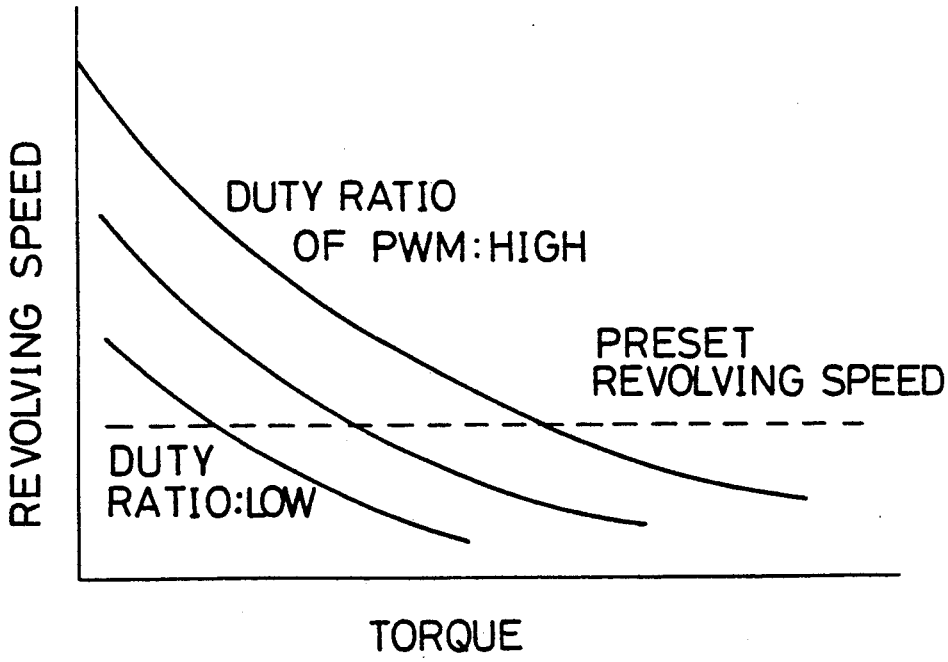
FIG. 22 is a diagram showing characteristic curves of the torque-revolution speed related to the duty ratio of PWM.

Now, a method of controlling the number of revolutions of the motor will be explained with reference to FIGS. 21 and 22.

It has been described that the operating points A and B in FIG. 20 is in a range of the power of the motor and that the drum can be rotated. In practical operation with the revolution speed predetermined, the power of the motor must pass the operating points. FIG. 21 shows a waveform in which the output base signal shown in FIG. 19 is subjected to pulse width modulation, where a duty ratio is about $\frac{2}{3}$ in a waveform (a) while it is about $\frac{1}{3}$ in a waveform 8*b*). As shown in FIG. 22, as the duty ratio of PWM becomes smaller, the power decreases to have a curve drawn in lower position.

Figure 19:
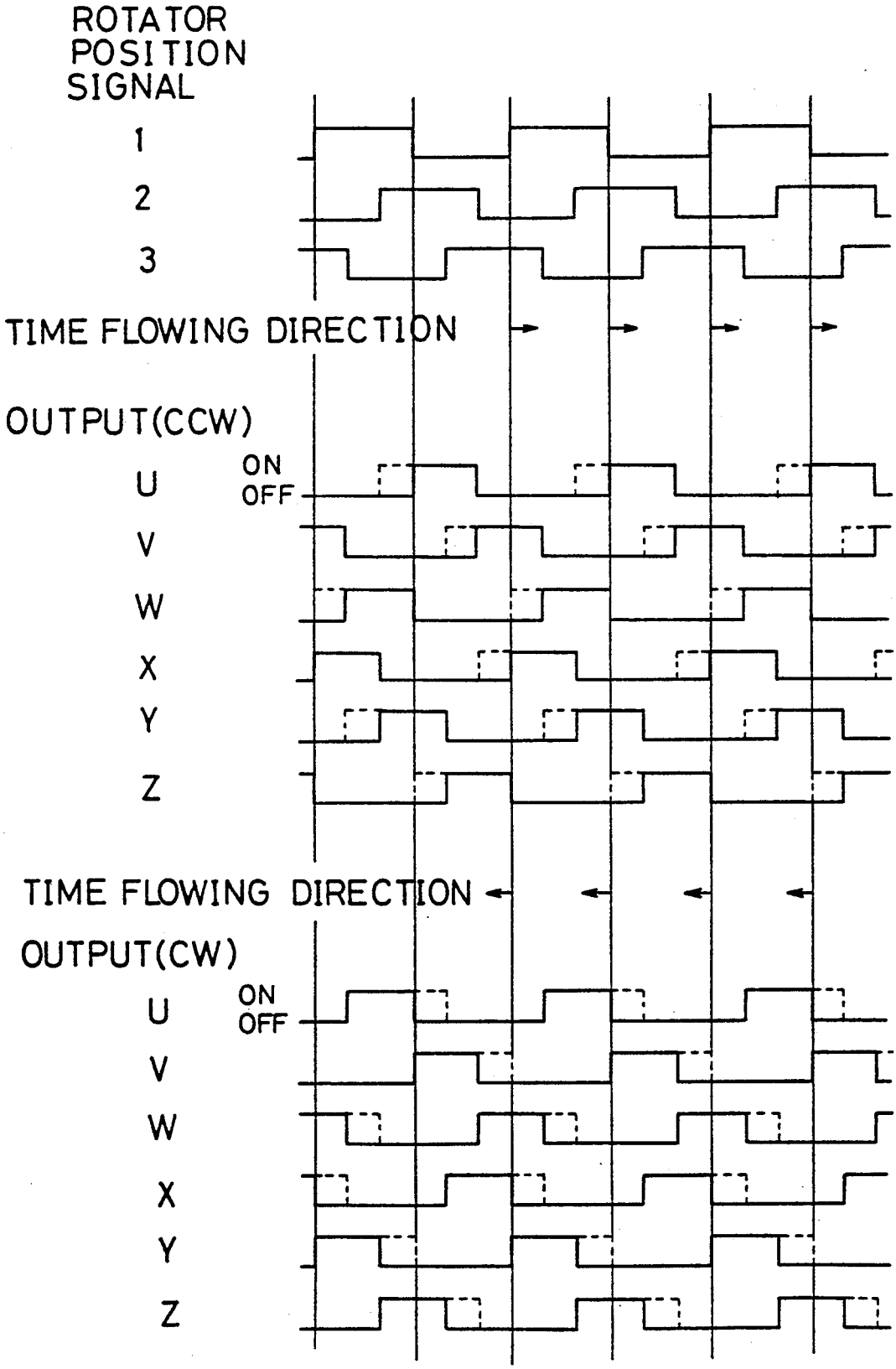
FIG. 19 is a wave form chart showing rotor position signals and driving voltage of the motor.

While the motor 13 is working, the microcomputer 76 always inspects a state of the rotor position signal shown in FIG. 19. In this embodiment, if the revolution speed is set a single turn per second, the duty ratio of PWM is controlled to be increased or decreased so that the cycle of the rotor position signal becomes $\frac{1}{4}$ second (this is because the motor make a turn in four cycles).

If a rotor position signal pulse is not inputted after $\frac{1}{4}$ second obtained by calculation elapses, the microcomputer 76 decides that a too large load delays the revolution of the rotor, and it applies a higher duty ratio of the output base signal next time. On the contrary, if the pulse is inputted before the $\frac{1}{4}$ second elapses, the microcomputer 76 decides that the rotor rotates too fast, and it applies a lower duty ratio of the output base signal next time.

In this way, the power of the motor always passes the operating point of a load, and hence, the motor keep a predetermined speed of revolutions in spite of the variation in a load torque.

Thus, the drum 12 can perform a non-stage transmission in a wide range of speed.

7. Revolutions of Drum and Balance Control

The drum 12 is cylindrical in shape, and is rotated forward or backward at the specified number of revolutions by the motor 13, as previously mentioned.

In the washing step, the washing operation is performed under control of the program (for the tumbling washing) according to which the drum 12 is rotated with the rotation speed $\omega s$ smaller than the critical rotation speed $\omega o$ at which the washing is tumbled, under control of the program (for the light cleaning washing where the washing laying against the wall of the drum is soaked in wash water) according to which the drum 12 is rotated with the rotation speed $\omega h$ larger than the critical rotation speed $\omega o$, or under control of the program (for the high washability washing) according to which the drum 12 causes the washing to be tumbled with the agitator disc 15 fixed and with outer force (physical force) being applied to the washing to enhance the washability.

The gravitational acceleration is well-balanced with centrifugal force, and this leads to an equation $mg = mr\omega o^2$. In accordance with the equation, the critical rotation speed (angular velocity) $\omega o$ is calculated as follows:

$$\omega o = \sqrt{g/r}$$

where m denotes a quantity of the washing, r denotes a radius of the drum and g denotes a gravitational acceleration.

The rotation of the drum 12 with the rotation speed higher than the critical rotation speed (angular velocity) $\omega o$ causes the washing to be pushed against the inner circular wall of the drum 12 in some distribution state. Uneven distribution of the washing in the drum, uneven distribution of the washing results in the center of gravity of the composite quantity of the washing deviating from a horizontal axis of the drum, and this causes the drum to vibrate, and this also causes the washtub 9 having the motor 13 and the like to vibrate.

An amplitude X of the vibration of the washtub 9 is obtained in accordance with the following equation:

$$X = \left\{ \frac{M_A}{M} \cdot r \cdot \left(\frac{\omega}{\omega o}\right)^2 \right\} \Big/ \sqrt{\left\{1 - \left(\frac{\omega}{\omega o}\right)^2\right\}^2 + \left(2\xi \cdot \frac{\omega}{\omega_A}\right)^2}$$

where $m_A$ is an unbalance quantity, $\omega$ is a rotation speed of the drum, $\omega$ is a proper frequency, $\xi$ is an attenuation ratio, and M is a total mass of a vibrator.

In accordance with the above formula, it is apparent that as the total mass M increases, the vibration (amplitude) becomes small. In practical use, it is possible that a concrete block or an iron block is attached to the washtub 9 as a vibration proofing weight and the total mass M is made larger so that the vibration may be reduced. However, this method is not preferable because of the disadvantage that the resultant product has an undesirable large weight.

Figures 23A, 23B, 23C, 23D, 23E:
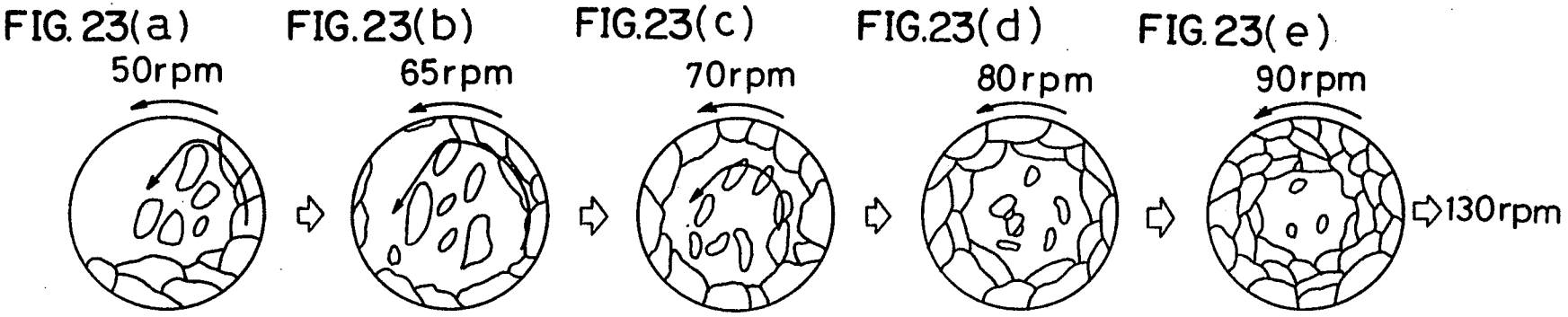
FIG. 23 is a diagram for explaining a state of the washing in the tumbling drum related to an increase of the rotation speed.

In the present invention, the revolution speed of the motor 13 can be set arbitrarily, and so it is possible to make the vibration caused by the rotation of the drum 12 ($\omega >> \omega$ 0) close to the vibration when the drum contains no load by gradually increasing the rotation speed of the drum 12 and unifying the distribution of the quantity of the washing in the drum 12 (the center of gravity of the composite quantity of the washing distributed in the drum is positioned corresponding to the horizontal axis of the drum). The washing in the drum 12 is gradually push against the inner circular wall of the drum 12 as the drum 12 revolves faster, and soon the washing makes a distribution in the shape of a ring. FIGS. 23(*a*) to 23(*e*) show the stages of making the distribution.

In the dehydrating step, as shown in FIG. 23, since the washing tumbled in the drum 12 is gradually push against the inner circular wall of the drum as the drum revolves faster, the diameter of the drum (inner diameter of the ring of the washing) becomes apparently smaller, and eventually, all the washing lie against the inner surface of the circular wall of the drum 12. When the distribution of the quantity of the washing is good, the center of gravity of the washing distributed along the inner circular wall of the drum 12 corresponds to the axis of the drum 12; this means a balanced state in which only considerably slight vibration occurs even in the centrifugal water-extracting (the rotation speed of the drum is 800 to 1000 rpm.).

Thus, the rotation of the drum 12 when the dehydrating operation is started varies from the low speed rotation (about 50 rpm) to the rotation speed (about 130 rpm) lower than both the resonance rotation speed of the washtub 9 and the high speed rotation in correspondence with the capacity for the washing in accordance with a balance chart shown in FIG. 24 in which the rotation speed of the drum 12 and the rotation time at the rotation speed are preset.

In this case, when the vibration of the washtub 9 which is detected by the vibration sensor S3 is an allowable value or under, the drum 12 continuously proceeds to the high speed rotation (e.g., 800 to 1000 rpm); contrarily, when it is more than the allowable value, the drum 12 is temporarily stopped, or it switch to the low speed rotation (cloth of the washing is loosened) and thereafter works in accordance with the balance chart in FIG. 24 again. If the vibration of the washtub 9 does not reach the allowable value or under even when this operation is thoroughly repeated a specified number of times (e.g., three times), the drum 12 is controlled to start with the rinsing operation again.

On the other hand, when the dehydrating operation just before the drying step is started, the drum 12 does not proceed to the maximum speed rotation (800 to 1000 rpm) even if the high speed rotation of the drum 12 causes the washtub 9 to vibrate at a level of the allowable value or under, but the drum 12 is rotated with the intermediate rotation speed (500 rpm) between the resonance rotation speed of the elastically supported washtub 9 and the high speed rotation speed of the drum 12 for a relatively long time (10 seconds or over, for example) so that the water-extracting efficiency may be 45% or so. After that, the rotation of the drum 12 is temporarily stopped, and then the drum 12 proceeds to the maximum speed rotation in accordance with the previously mentioned process.

When the dehydrating operation just before the drying step is performed in accordance with the above-mentioned process, there are advantages over the case in which water is rapidly extracted from the wet washing by utilizing centrifugal force as in the ordinary dehydrating step; that is, the washing can be prevented from tightly lying against the inner circular wall surface of the drum 12, the washing can be easily tumbled when the process proceeds t the drying step to enhance the drying efficiency, and the washing finished in the drying operation is wrinkled at a lower rate.

The capacity for the washing is detected by the water level sensor S1 and flow rate sensor S4. For example, water is supplied to a predetermined water level after the washing is introduced in the washtub, and thereafter, the washtub is rotated at low speed for a predetermined period. After that, water is further supplied to the predetermined water level to detect the capacity in accordance with an amount of the water supplied at that time. The capacity shown in FIG. 24 is classified into "small" for 1 to 2 kg, "medium" for 3 to 4 kg and "large" for 5 to 6 kg when the maximum capacity is 6 kg, for example.

8. Control of the Drying Operation

Figure 25:
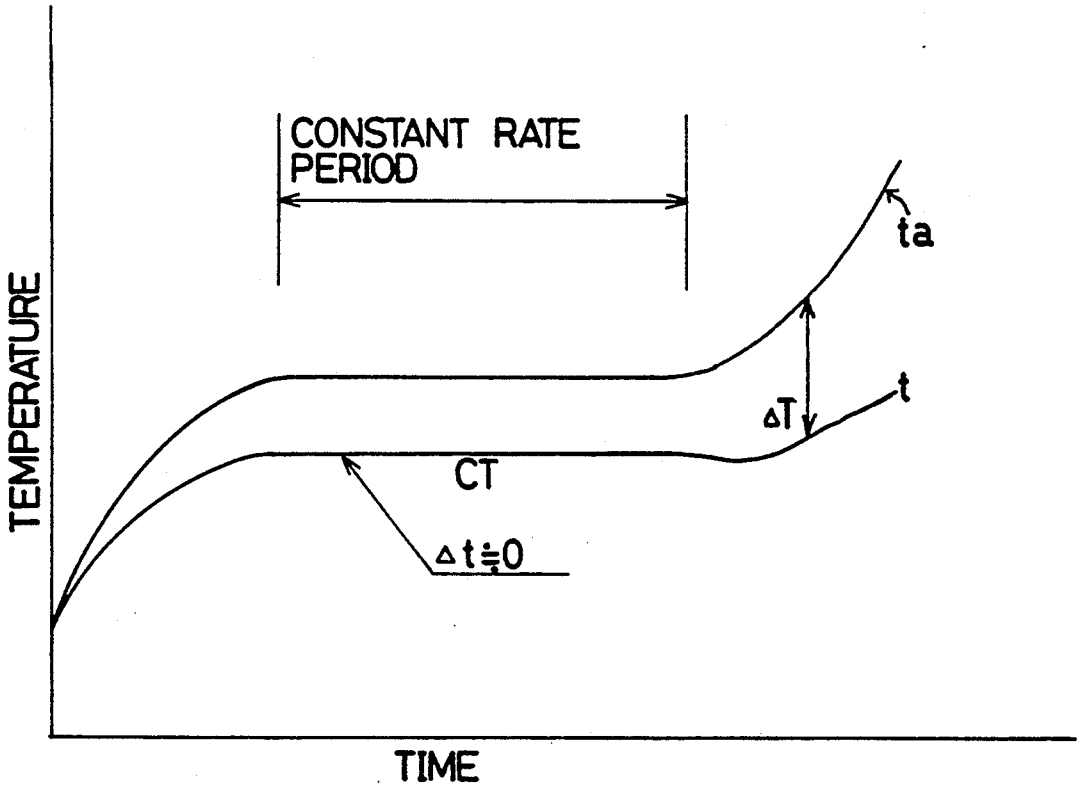
FIG. 25 is a graph showing curves of the time and temperature in the step of drying.

In the control device shown in FIG. 17, when the heater 31, blower 18 and motor 13 are energized, the drum 12 revolves while it is fed with hot water, and thus the drying operation starts. In the drying process of the washing in the drum 12, temperature "ta" detected by the temperature sensor 67 and temperature "t" detected by the temperature sensor 68 vary as shown in FIG. 25. Specifically, the temperatures "ta," and "t" gradually rise at the beginning, and soon the temperatures assume an increment $\Delta t \approx 0$ (constant rate period). When the constant rate period ends, the temperature "ta,", "t" begin to rise again, and if it is left as it is, the washing is excessively dried. Therefore, when a difference $\Delta T$ between "ta" and "t" attains a predetermined value, the energizing the heater 31 may be stopped to complete the drying. Conventionally, the excessive drying condition is intentionally maintained to prevent the washing from partially remaining undried.

In the present invention, however, the agitator disc 15 is fixed in opposition to the rotating drum 12 to stir the washing, or an arithmetic operation is performed about a signal of the temperature sensor 67 to control a current value of the heater 31 for preventing temperature from rising. Consequently, the washing can be dried well, and there is no possibility of excessive drying and excessively high temperature.

The drying operation will be further explained in detail with reference to the flow chart shown in FIGS. 26 and 27.

First, when the heater 31 is energized (Step 301) and the temperature "t" begins to rise, the temperature variation rate $\Delta t$ is detected, which is stored as $\Delta tu$ in the microcomputer 76 (Step 302). When the constant rate period set in, the temperature t does not vary ($\Delta t \approx 0$), the constant rate temperature is stored as CT (Step 303). When the variation rate of temperature $\Delta t$ ($>0$) is detected after the constant rate period changes at a constant temperature for a while (Step 304), the microcomputer 76 control (reduce) the current to the heater 31 (Step 305). Then, a condition of the temperature t is checked at Steps 306, 307 and 308, and the process proceeds to the drying completing step (Step 309) immediately or after the drying operation is continually completed for a predetermined time (Step 310), depending upon the condition of the temperature variation in the previous checking steps.

When a disturbance (a state in which the washing in the drum 12 is temporarily put to one side and tumbled) causes the temperature to temporarily rise for the constant rate period, the temperature t quickly drops due to the reduction of thermal power of the heater 31 to a lower value than CT stored in the microcomputer 76. Then, the thermal power of the heater 31 is increased (recovered) (Step 311), and it is checked whether the detected temperature t recovers to CT stored in the microcomputer 76 (Step 312). After that, Step 304 is implemented while the drying is advanced under control. In this way, eventually imperfect drying and excessive drying can be avoided.

Figure 27:
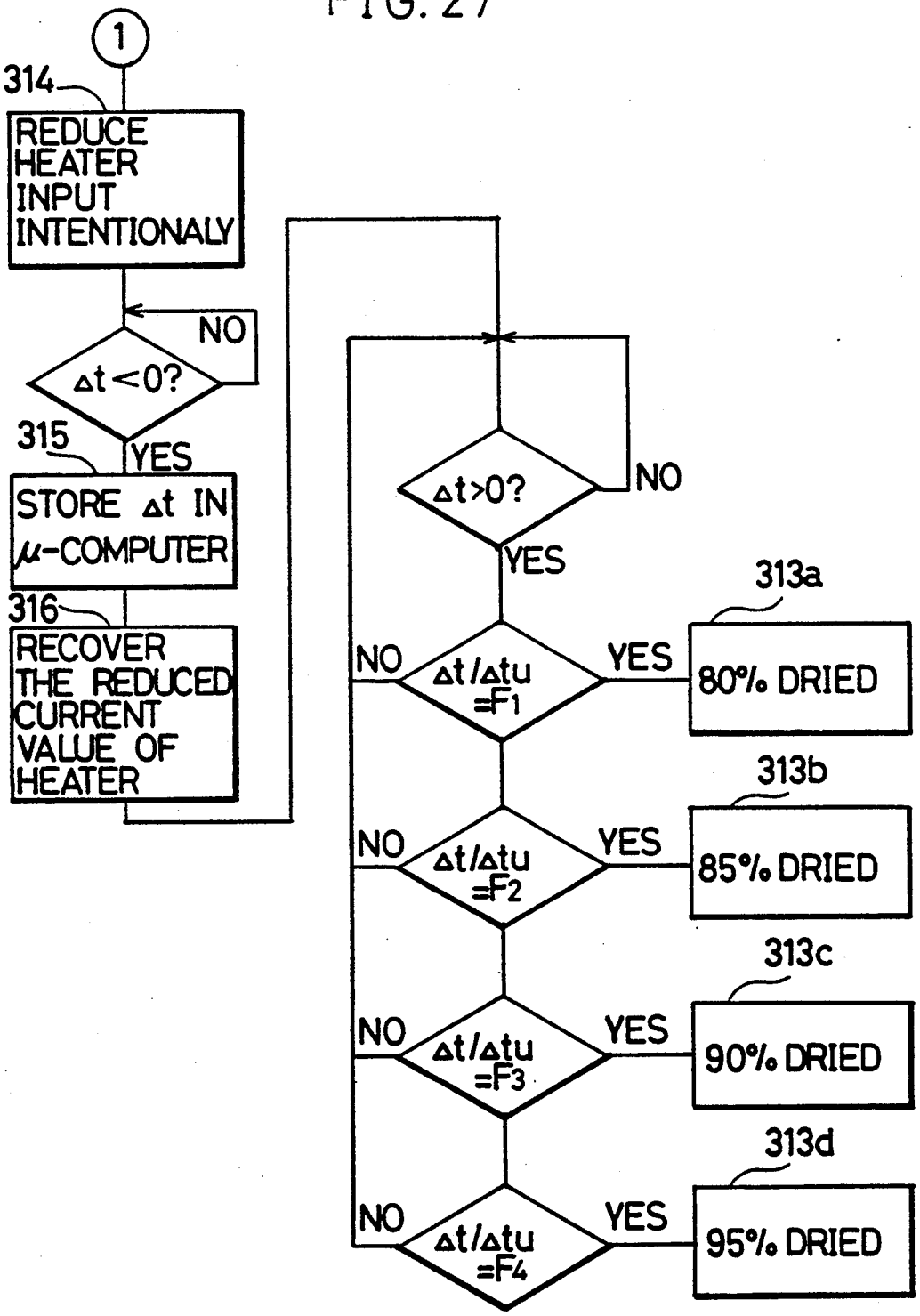

In the ironing course, sometimes the drying must be completed attaining a drying efficiency the user desires, as shown in FIG. 27 (Steps 313*a*, 313*b*, 313*c* and 313*d*). At this time, the operation is controlled so that the thermal power of the heater 31 may be intentionally changed (Step 314), and after the variation rate $\Delta t$ in temperature is stored as $\Delta td$ in the microcomputer 76 (Step 315), the current supplied to the heater 31 is recovered (Step 316).

When the temperature is recovered, the drying efficiency is controlled in accordance with fuzzy inference and fuzzy control, comparing the variation rate $\Delta t$ with $\Delta tu$ stored in the microcomputer 76, and the operation is completed. (Steps 313*a*, 313*b*, 313*c* and 313*d*). F1, F2, F3, and F4 are measured values which are experimentally obtained using devices in this embodiment.

In this embodiment, when the non-tumbling drying course (the drying by rotating the drum with the critical rotation speed or over) is selected, uneven drying is easily caused especially when less load is charged, and moreover, the constant rate period is short; the temperature t varies in a short period. In this case, when $\Delta t > 0$ is detected, the rotation speed of the drum 12 is reduced to $\omega < \omega o$ (critical rotation speed), the drum 12 tumbles the washing therein to vary the distribution of the clothes, and then the drum 12 is rotated with the non-tumbling rotation speed ($\omega > \omega o$) again for advancing the drying stage). The variation in the rotation speed is automatically repeated until the drying is completed. The power of the heater 31 can be selected among HIGH, MEDIUM, LOW depending upon a kind and quantity of the load in advancing the above-mentioned drying operation.

Figure 28:
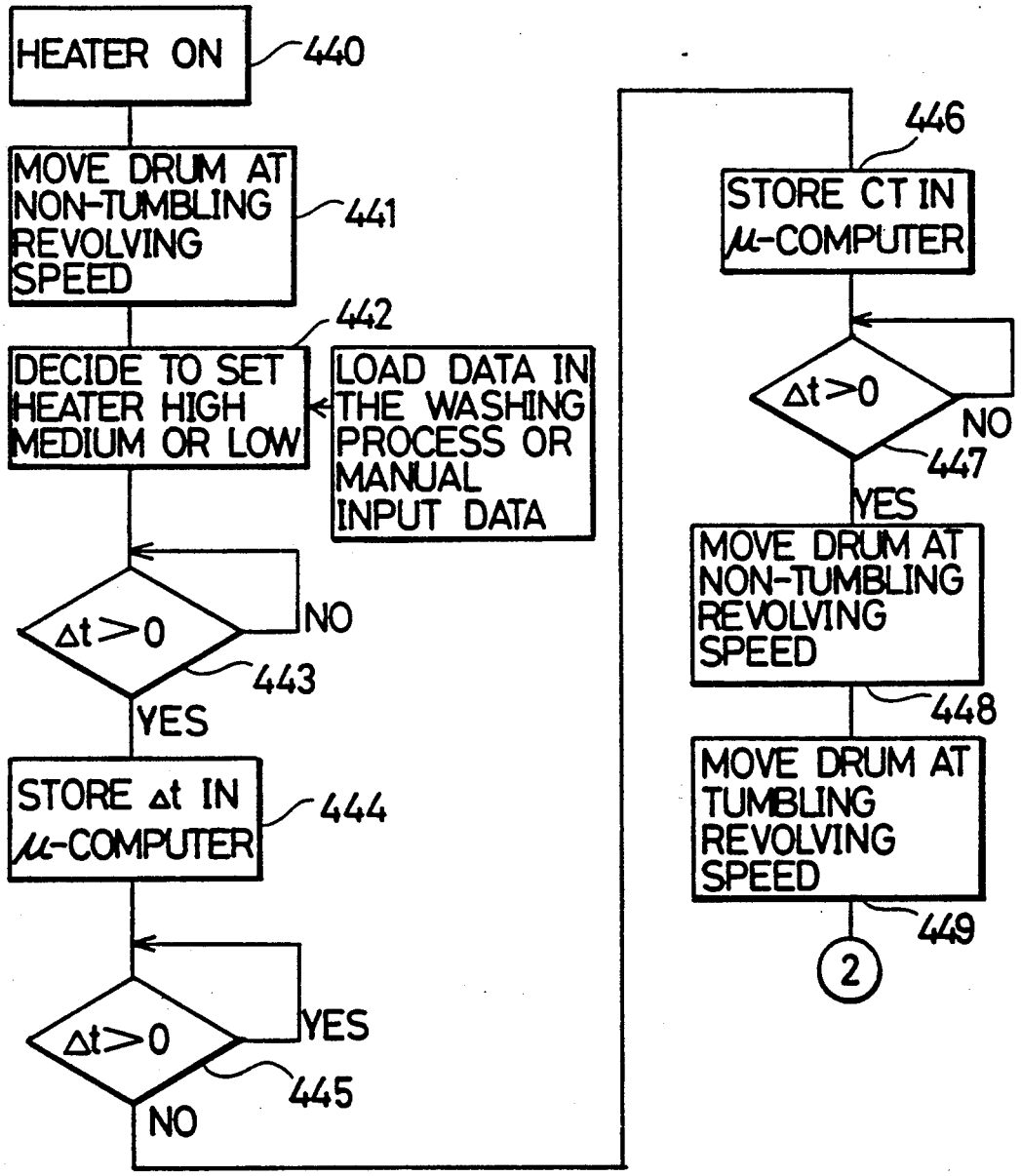

The non-tumbling ($\omega > \omega o$) drying will be described in detain in conjunction with a flow chart in FIG. 28 below.

First, the heater 31 is turned ON (Step 440), the drum 12 is rotated in non-tumbling ($\omega > \omega o$) (Step 441), and thus, the non-tumbling drying process starts. The microcomputer 76 performs arithmetic operations based upon load data in the washing process (capacity for the load, quality of the cloth, quantity of rinsing water, water-extracting efficiency, etc.) and manually input data to infer an approximate drying time, and the power of the heater 31 is selected among HIGH, MEDIUM and LOW (Step 442). An increase in temperature of the washing is detected (Step 443), the temperature rising rate $\Delta tu$ is stored in the microcomputer (Step 444). A temperature variation at the ensuing time is detected (Step 445); if it becomes almost constant, the constant rate temperature CT is stored in the microcomputer 76 (Step 446). A temperature variation at the ensuing time is observed (Step 447); if a temperature rising is recognized, the drum 12 repeats the programmed operation several times, under control with the tumbling rotation speed (Step 448), and thereafter, it revolves with non-tumbling rotation speed again (Step 449). In the ensuing time, the Steps 447 to 449 may be repeated.

Figure 26:
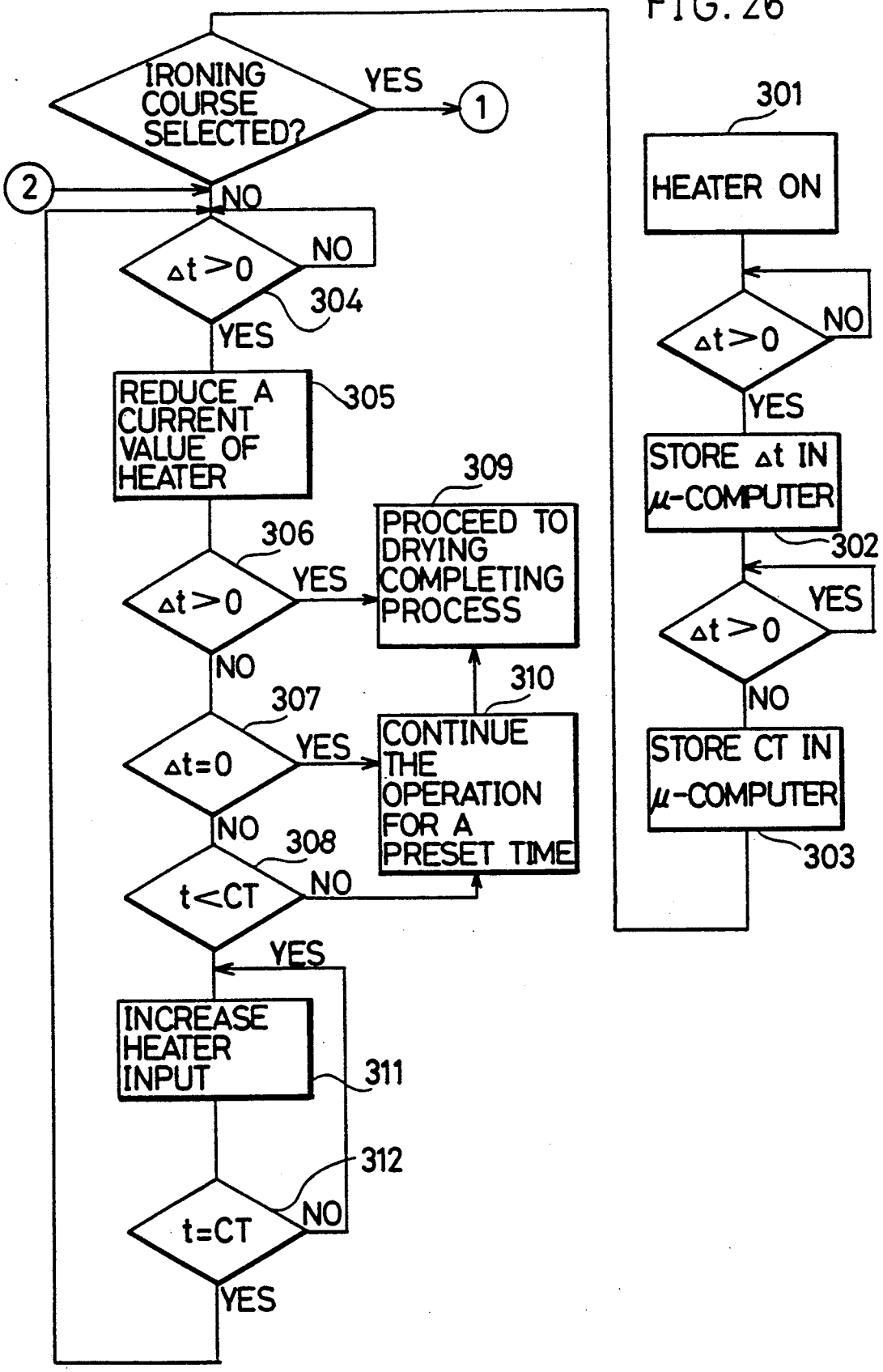
FIGS. 26 to 28 are flow charts showing the operation of the tumbler type washing/drying machine in the step of drying.

The ensuing steps are performed under control in accordance with Steps 304 to 312 shown in FIG. 26, and thus the drying is completed.

FIG. 29 shows a temperature variation in the washing and related current value in the ordinary drying operation. When a temperature variation at the end of the drying operation is detected and a current value to the heater 31 is decreased, the drying is completed in accordance with Steps 306, 307, 308, 309 and 310 in FIG. 26.

Figure 30:
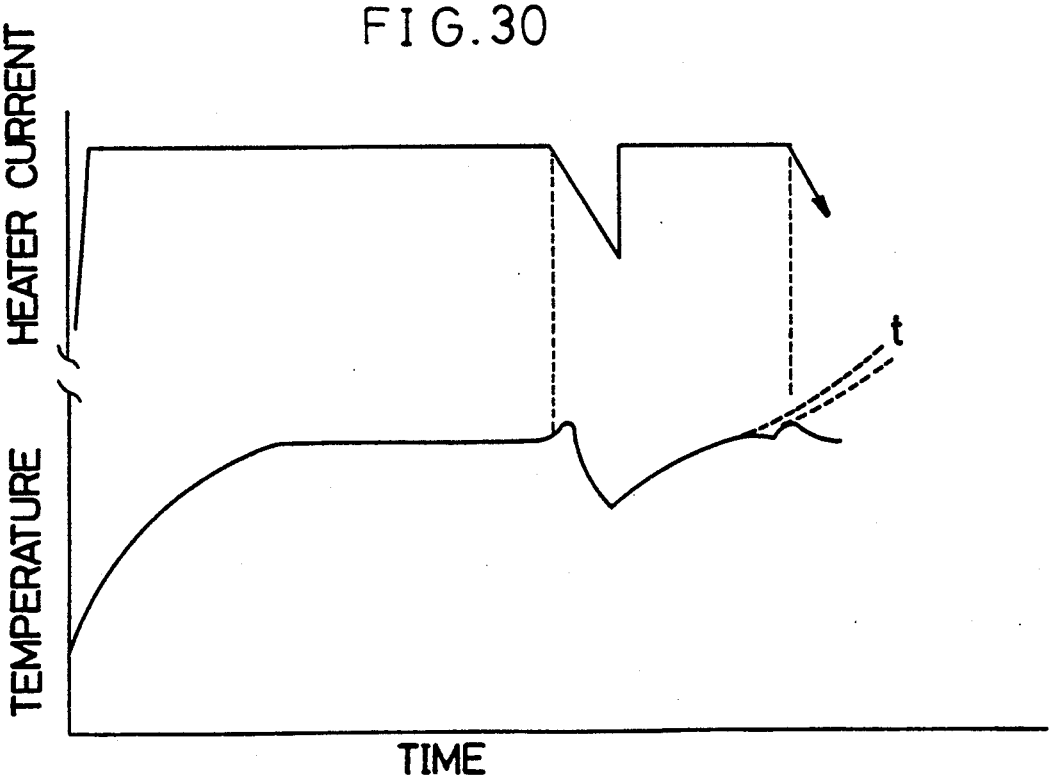

FIG. 30 shows a current variation and temperature variation when the current value of the heater 31 is intentionally reduced to check the drying efficiency (Step 314 to 316 in FIG. 27) and also shows a state in which the temperature automatically reaches a temperature at the end of the drying operation after the first current variation. Sometimes, intentionally the current is automatically varied several times to pre-estimate the desired drying efficiency.

9. Continuous Operation from Washing to Drying

Figure 31:
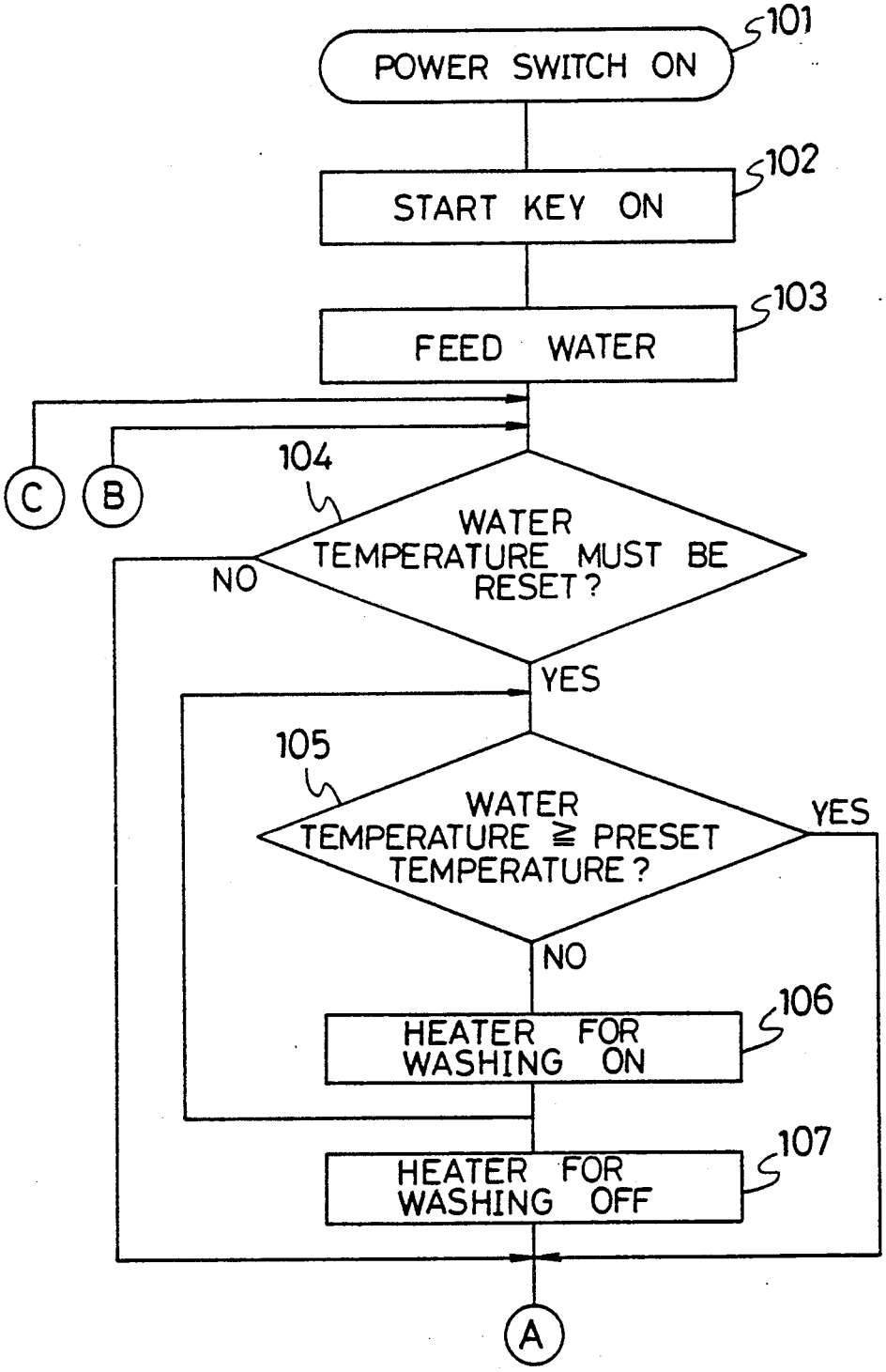
FIGS. 31(*a*)–31(*f*) are flow charts successively showing the steps of washing, rinsing, dehydrating (extracting water) and drying in the tumbler type washing/drying machine according to the present invention.
Figure 31:
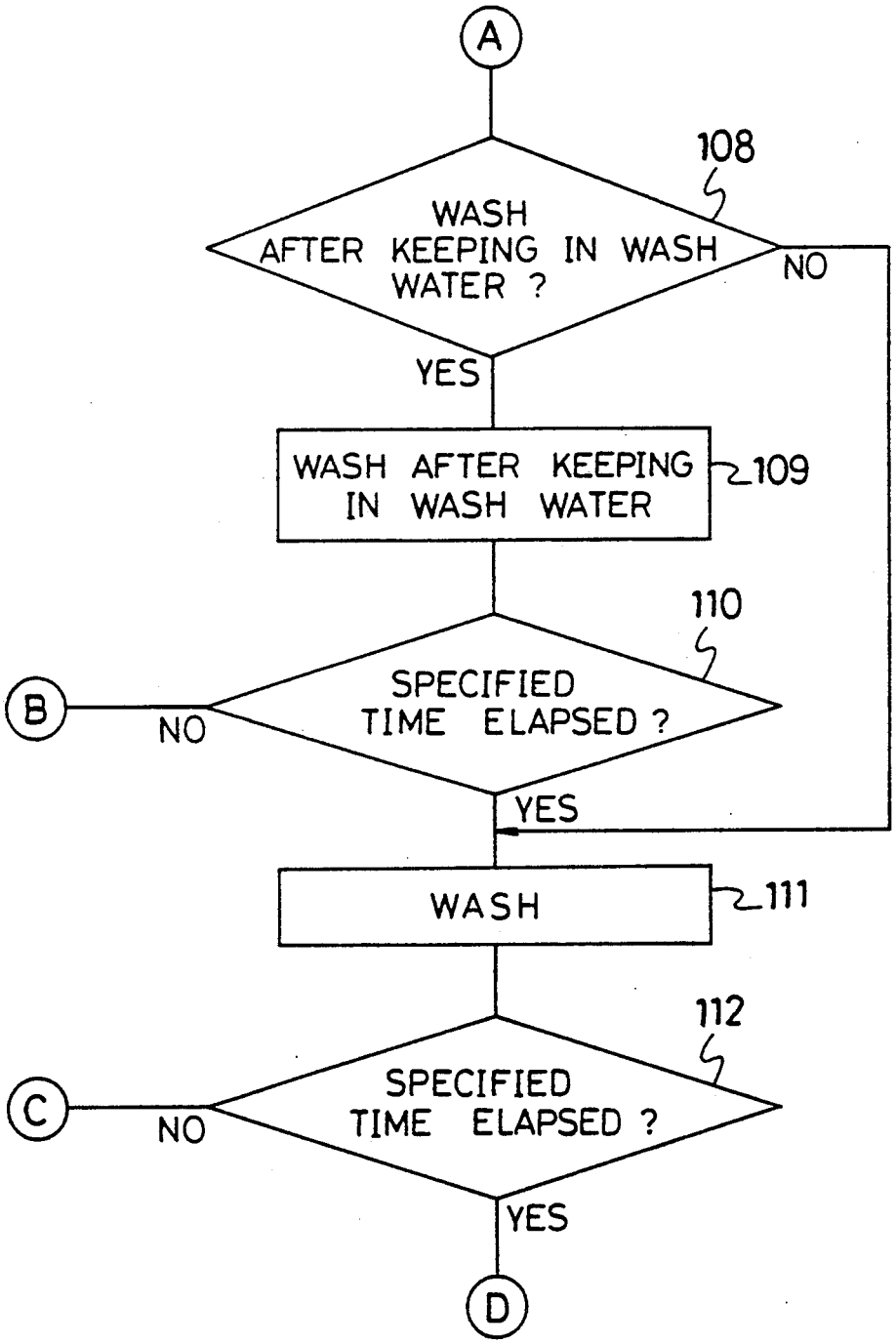
Figure 31:
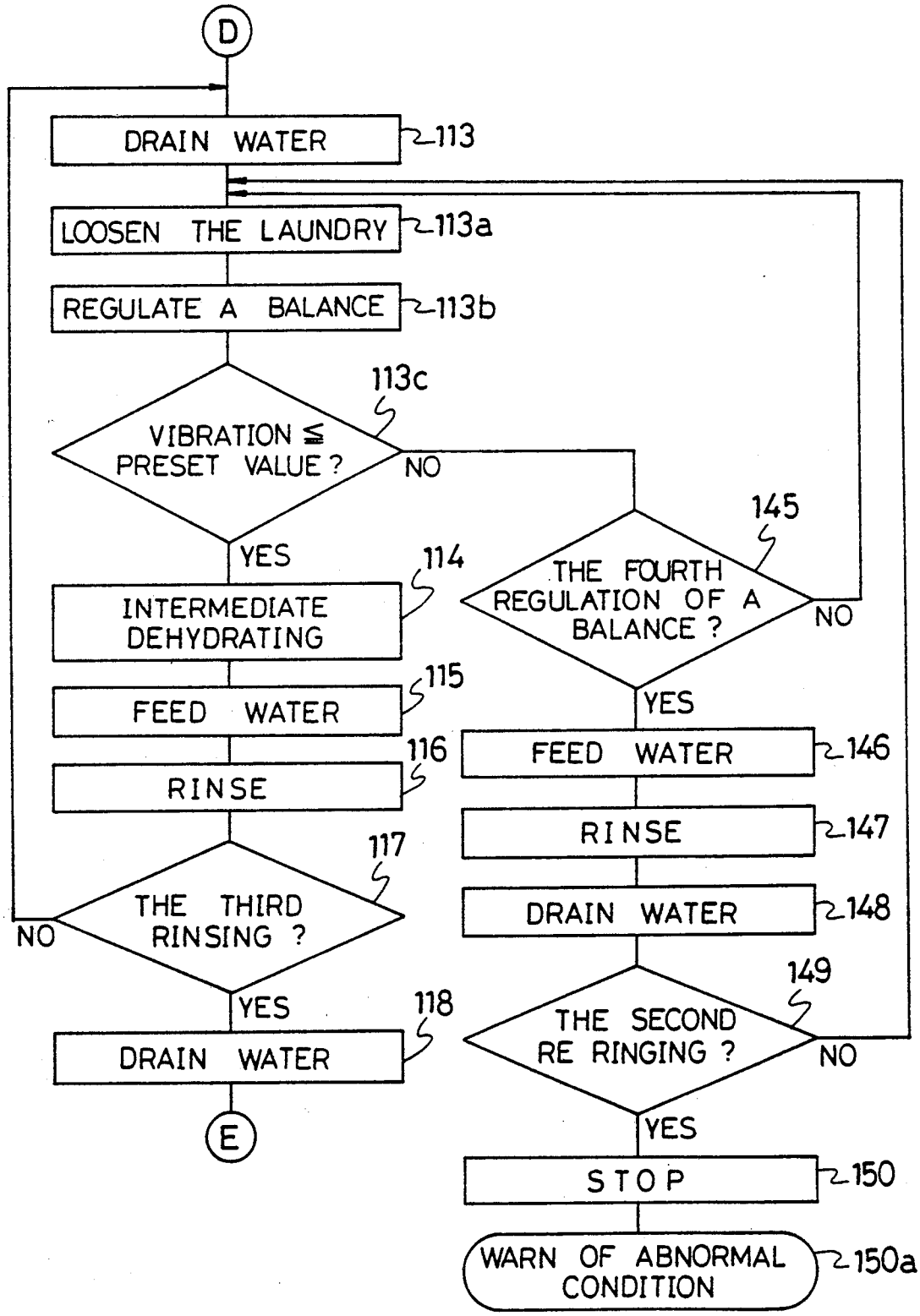
Figure 31:
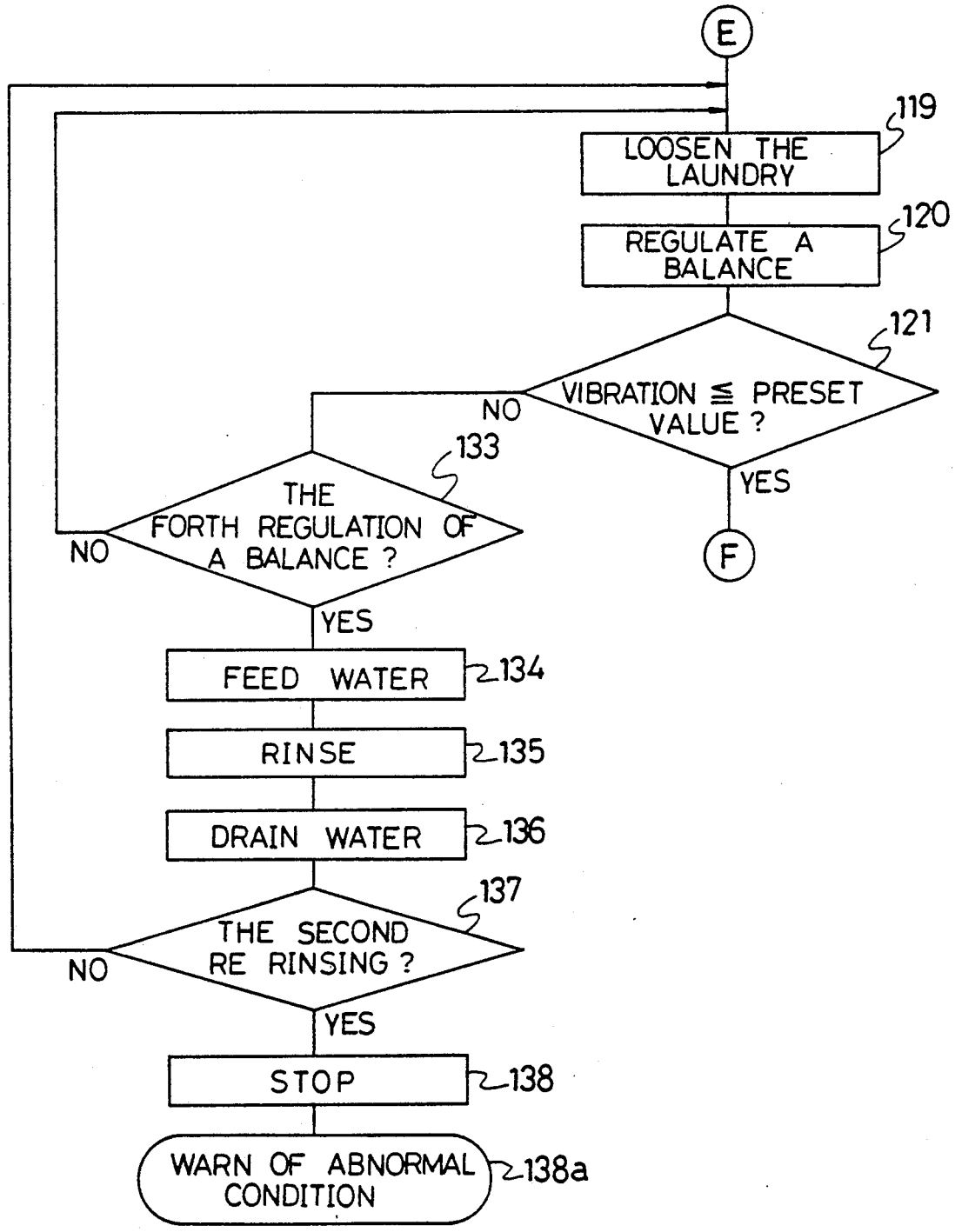
Figure 31E:
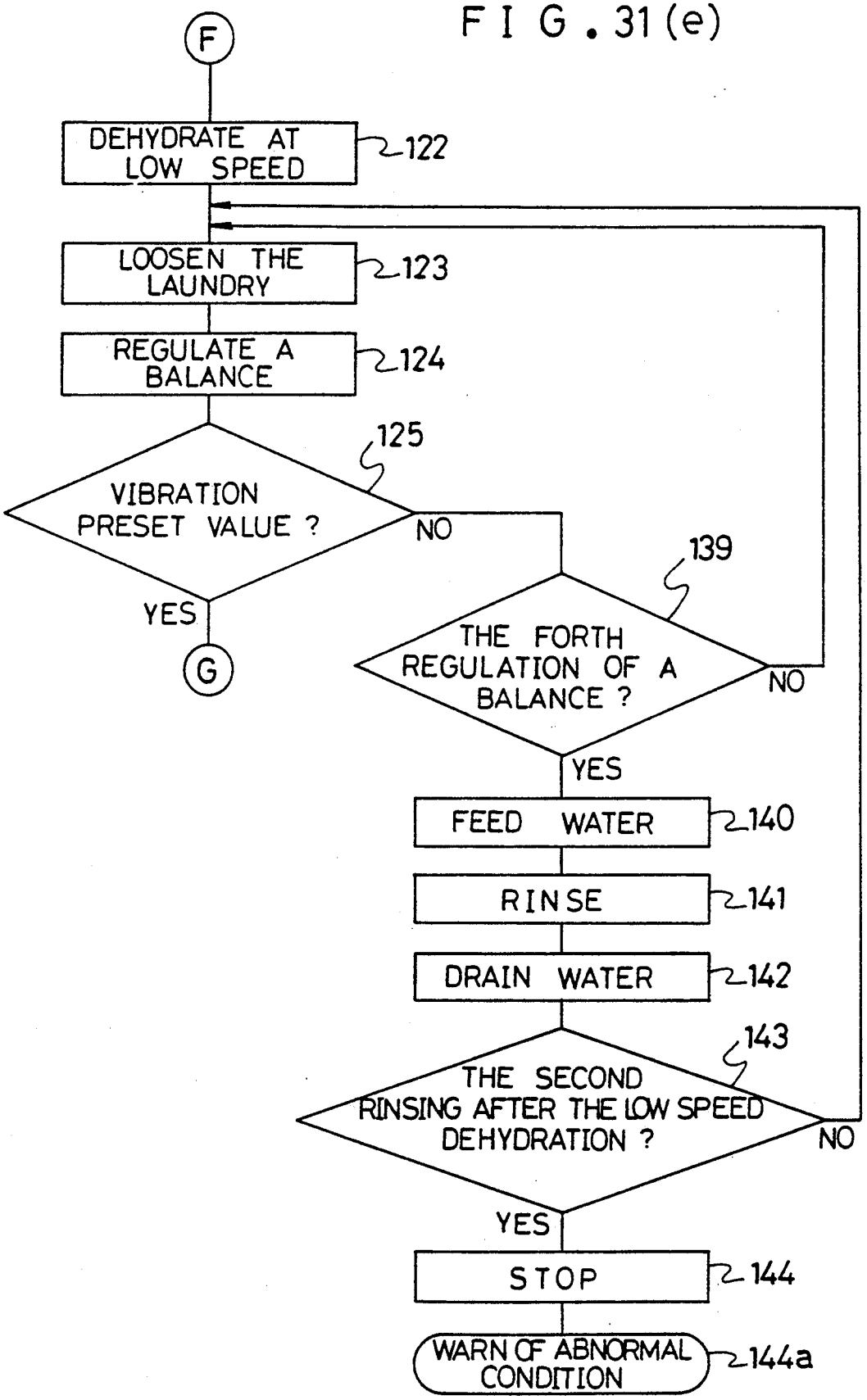
Figure 31:
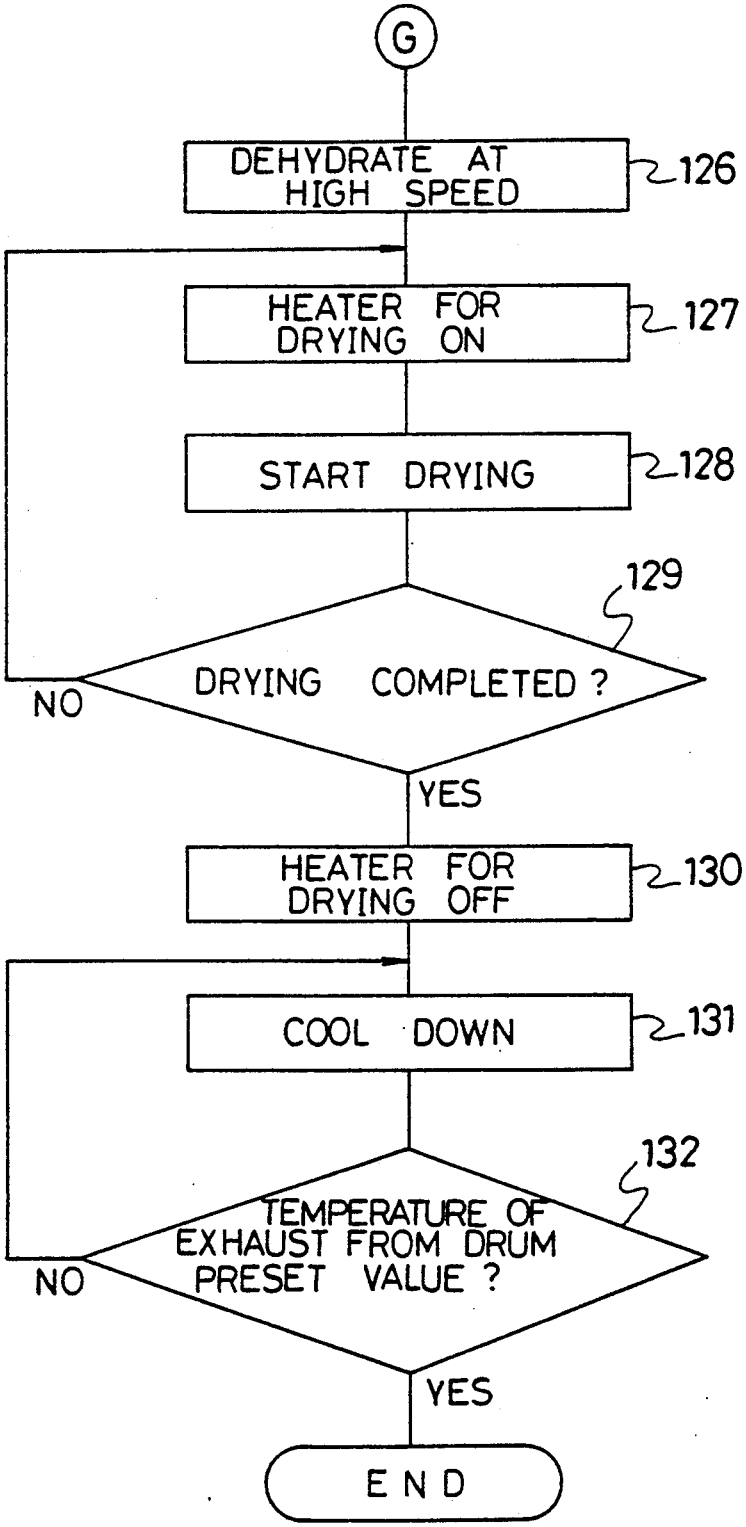
Figure 32A:
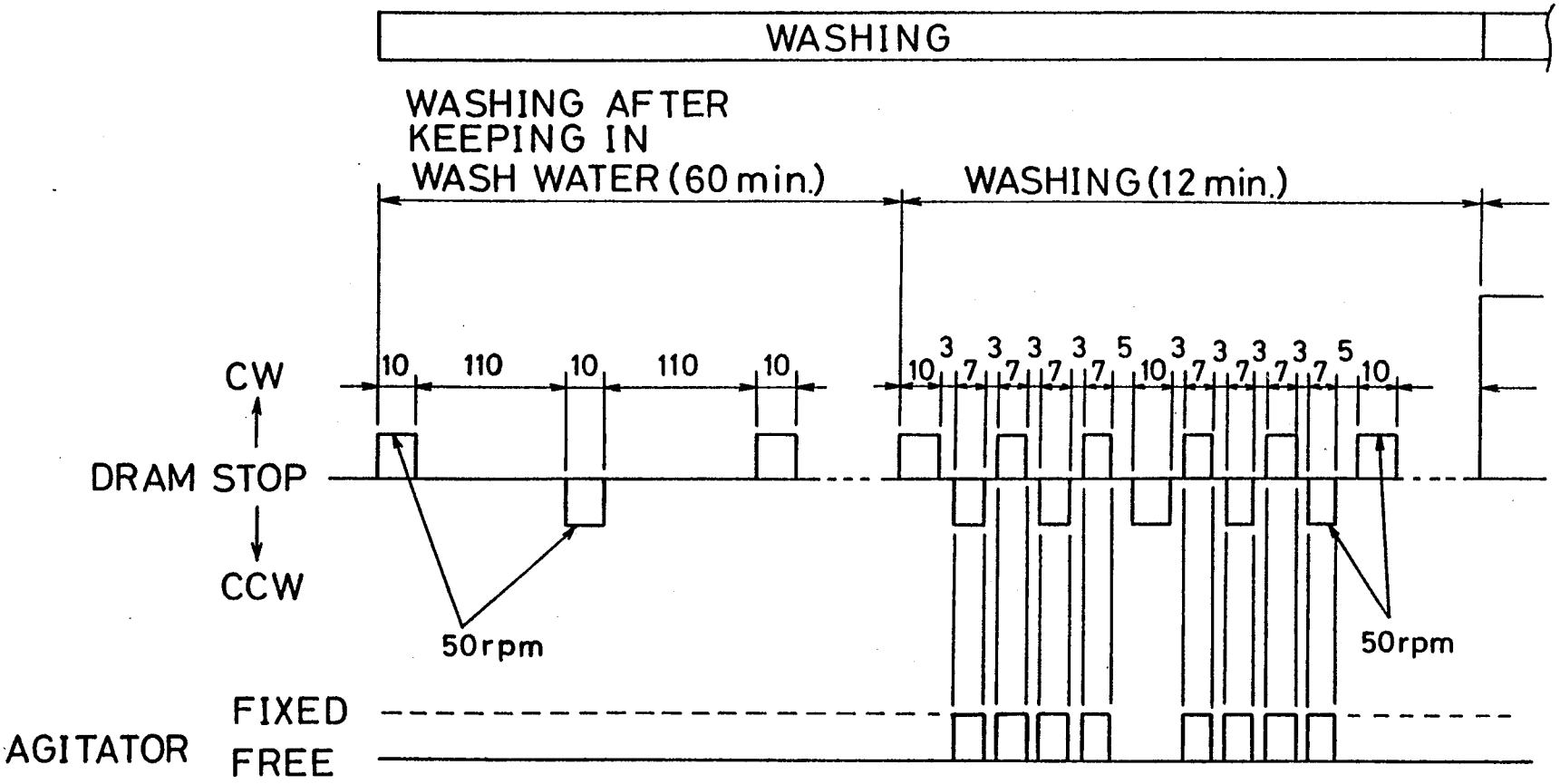
FIGS. 32(*a*)–32(*e*) are time charts in correspondence with FIGS. 31(*a*)–31(*f*).
Figure 32:
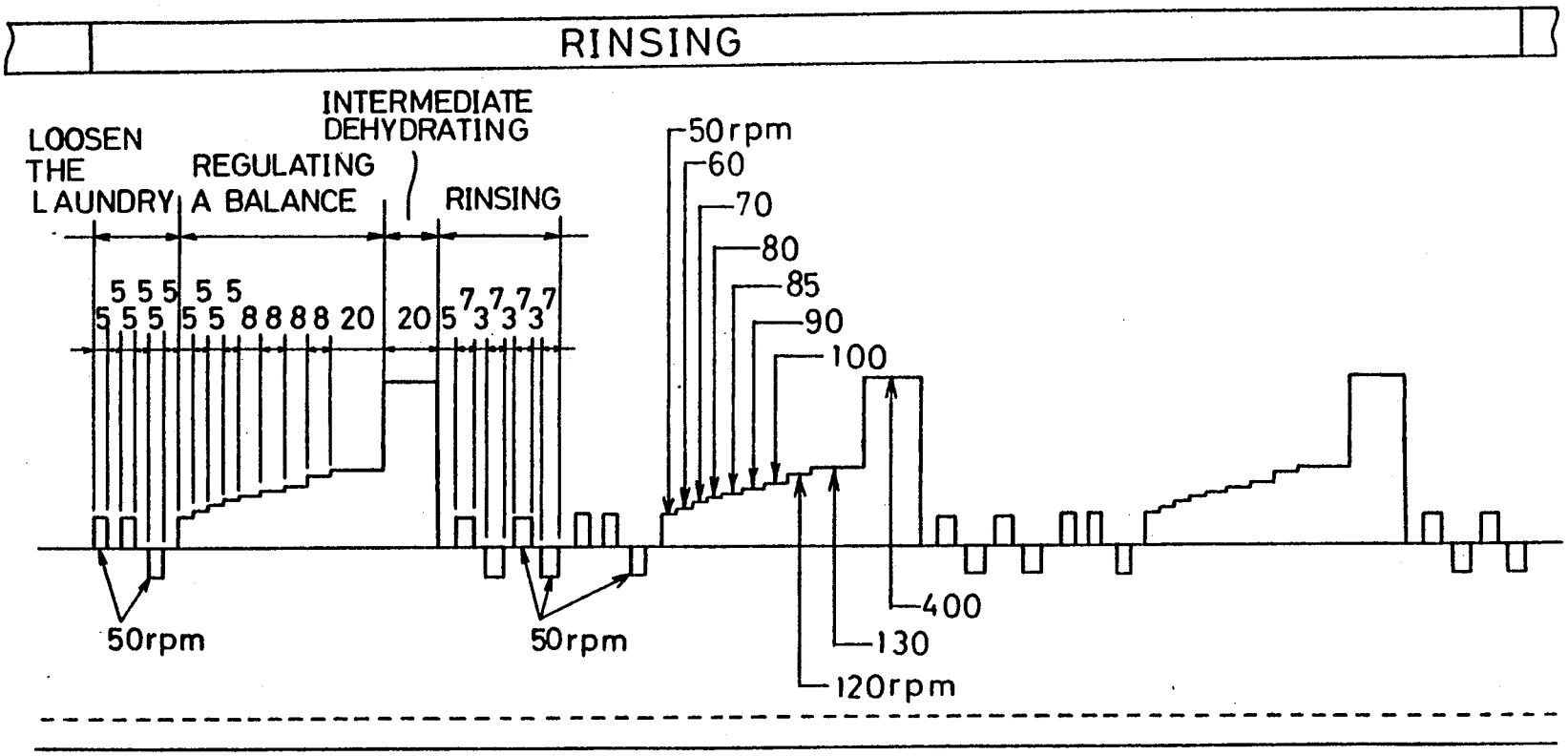
Figure 32C:
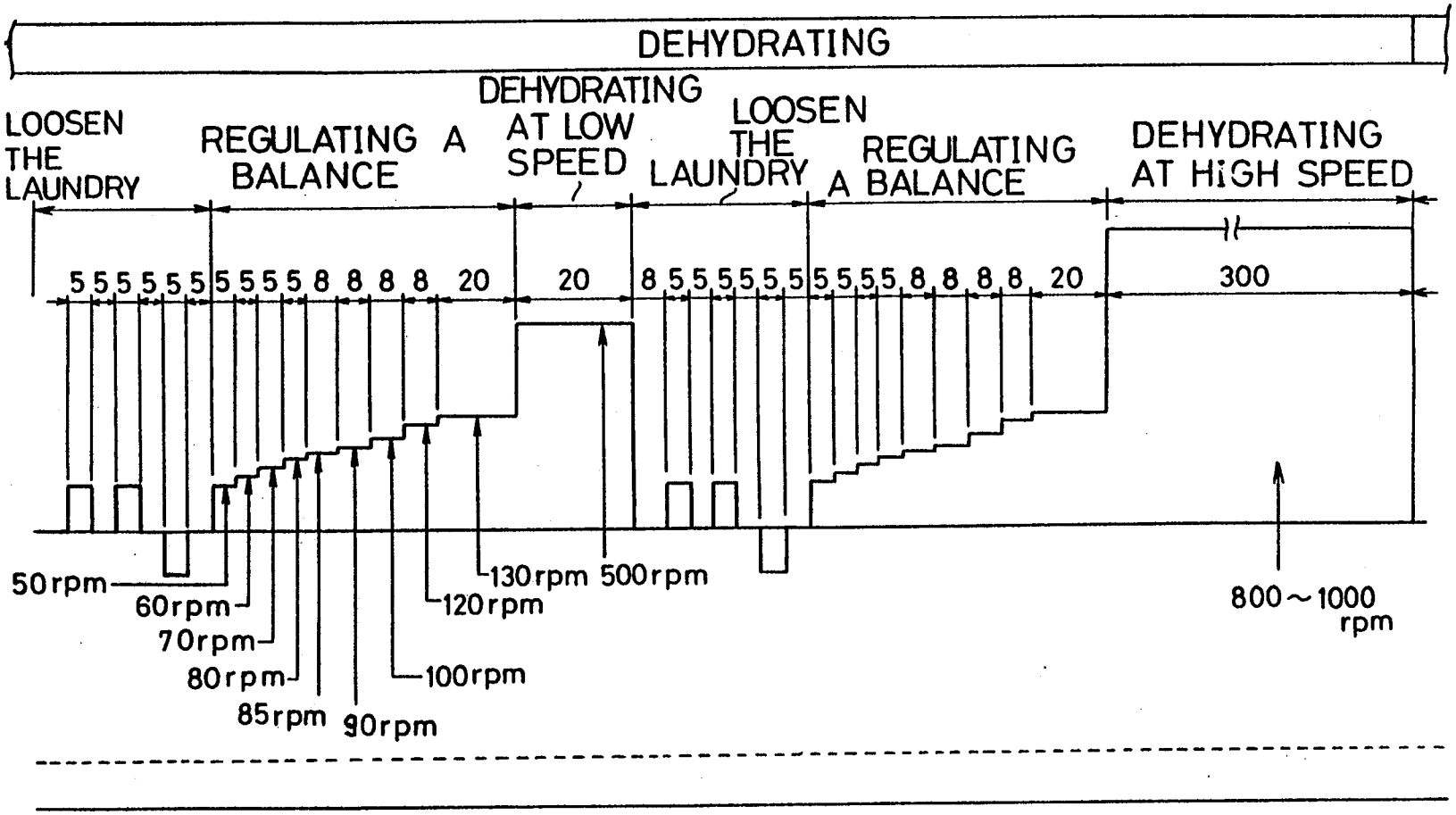
Figure 32D:
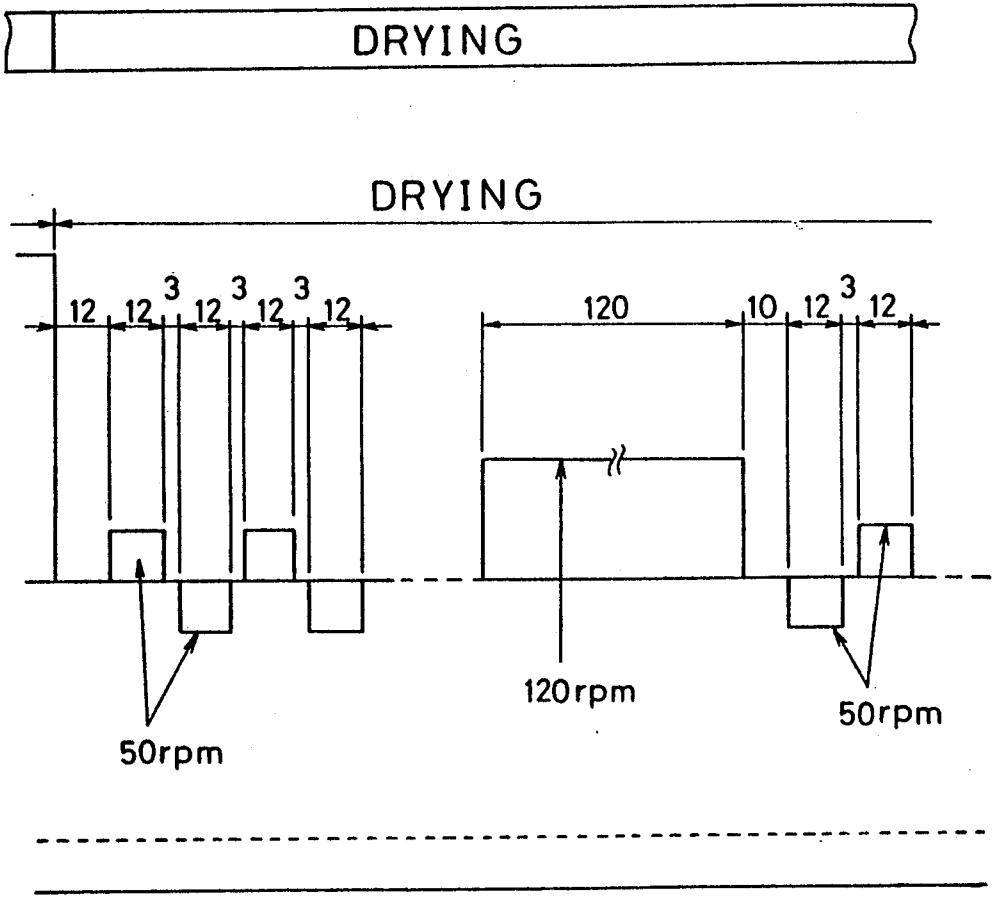
Figure 32E:
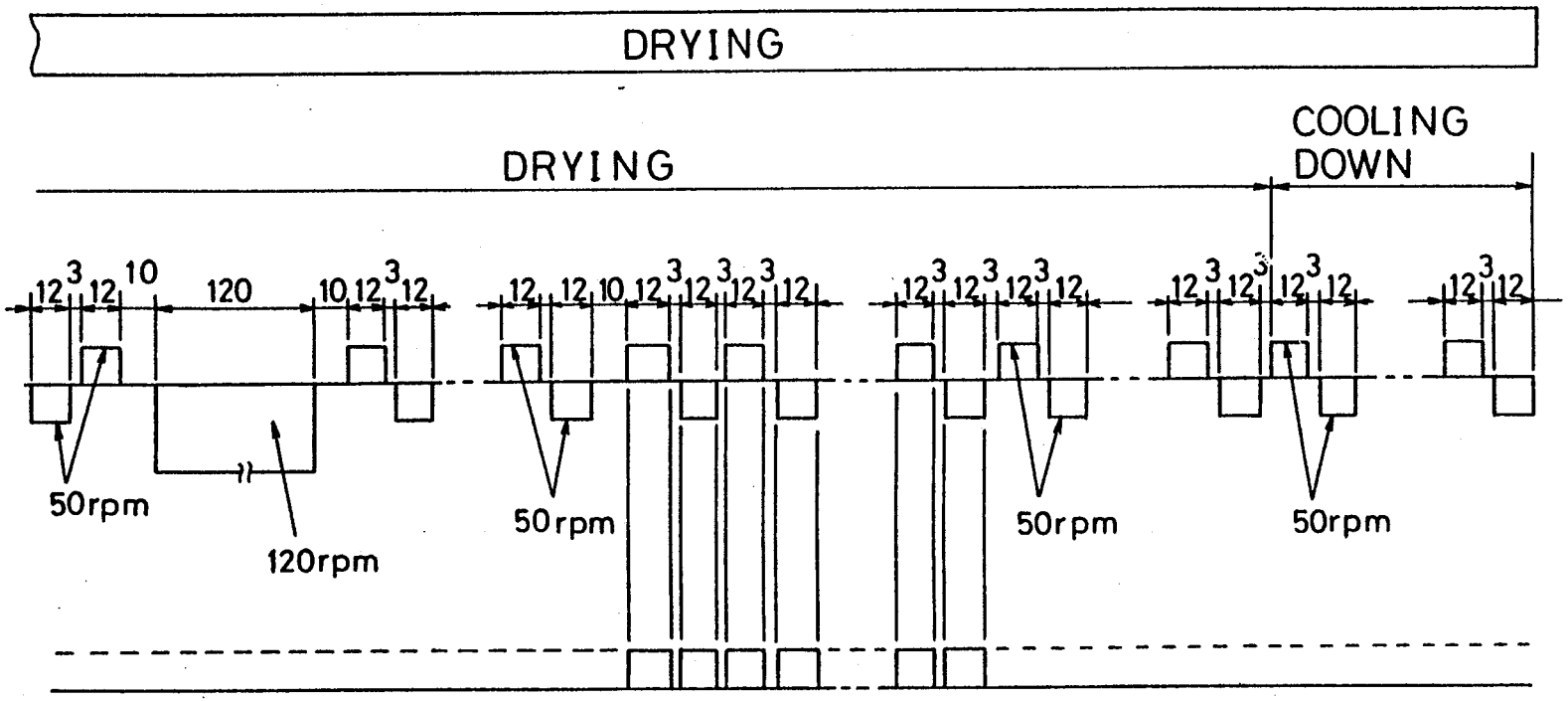

Continuous operation steps of washing, dehydrating and drying in the washing/drying machine according to the present invention will be explained in conjunction with flow charts in FIGS. 31(*a*)–31(*f*) and timing charts in FIGS. 32(*a*)–32(*e*).

When the power switch 8 and start key of the operating unit 6 are turned on, the feed valve 10 is energized and water supply is started (Steps 101 to 103). When a water temperature is set in the operating unit 6, the hot water heater 32 is energized until the water temperature reaches the preset temperature (Steps 104 to 107). Next, when "keeping the washing in wash water before washing" is preset in the operating unit 6, "keeping in wash water before washing" is carried out for a predetermined period (60 minutes) (Steps 108 to 110). At this time, as shown in FIG. 29, the agitator disc 15 is in free rotation condition to revolve forward at 50 rpm. Then, the "washing" is carried out for a predetermined period (12 minutes), and as shown in FIG. 32(*a*), the drum 12 repetitively revolves forward and backward alternately, and the agitator disc 15 is intermittently fixed (Steps 111, 112). Next, the rinsing operation is performed. In the rinsing operation, first water is drained, and then, the drum 12 is rotated forward and backward alternately at 50 rpm several times to loosen the clothes (Steps 113, 113*a*). Then, the drum 12 is rotated in one way, and the rotation speed of the drum 12 is increased in stages from 50 rpm to 130 rpm to regulate the balance (Step 113*b*). If the vibration of the washtub 9 is a given value or under (Step 113*c*), the drum 12 is rotated at 400 rpm for 20 seconds to perform "intermediate water-extracting" (Step 114). Then, water is supplied (Step 115), and the drum 12 is rotated forward and backward alternately at 50 rpm several times to rinse the washing (Step 116). As the operation including the Steps 113 to 116 are repeated three times, water is drained (Step 118), and thus, the operation proceeds to the draining step. At Step 113*c*, unless the vibration of the washtub 9 is the given value or under, the operation including the Steps 113*a* to 113*b* is repeated four times at most, and after the fourth performance is completed, the rinsing operation in accordance with Steps 146 to 148 is performed. If the rinsing operation in accordance with the steps 146 to 148 is repeated twice (Step 149), it is recognized that it is difficult to control the vibration of the washtub 9 to the given value or under, and the operation is interrupted and the display unit 7 indicates "ABNORMAL" (Steps 150, 150*a*).

In the dehydrating operation, the drum 12 is rotated forward and backward alternately several times at 50 rpm for 35 seconds to loosen the clothes (Step 119). The rotation speed of the drum is increased in stages from 50 rpm to 130 rpm to regulate the balance. If the vibration of the washtub 9 is a given value or under, the drum 12 is rotated at 500 rpm for two minutes to perform "low speed water-extracting" (Steps 120 to 122). "Loosening the clothes" and "regulating the balance" are carried out again, and if the vibration of the washtub 9 is a given value or under, the drum 12is rotated at 800 to 1000 rpm for 300 seconds to perform "high speed water-extracting" (Steps 113 to 126). At Step 121, unless the vibration of the washtub 9 is the given value or under, the operation including the Steps 119 to 120 is repeated four times at most, and the fourth performance includes the rinsing steps, Steps 140 to 142. If the rinsing operation in accordance with the Steps 140 to 142 is repeated twice, it is recognized that it is difficult to control the vibration of the washtub 9 to the given value or under, and the operation is interrupted and the display unit 7 indicates "ABNORMAL" (Steps 144, 144*a*).

As the "high speed water-extracting" at Step 126 is completed, the drying operation is carried out. In the drying operation, the heater 31 and blower 18 are energized, hot air is supplied to the drum 12, a temperature control of the hot air is carried out, and the drum 12 is rotated forward and backward alternately while the agitator disc 15 is fixed or released as shown in FIG. 32(*e*) (Steps 127, 128). When the drying operation is completed (Step 129), the energizing of the heater 31 is stopped (Step 130), cooling air is supplied to the drum 12 until the temperature detected by the temperature sensor 68 falls to a given value or under to perform "cooling down" (Steps 131, 132), and thus, the process is thoroughly completed.

10. Comparison Test of This Embodiment with Prior Art Embodiment

With regard to the basic performance from the washing to the drying, the results of a comparison test of this embodiment with a prior art embodiment is shown in the following Table I.

TABLE I

| ITEMS | THIS EMBODIMENT | PRIOR ART |
|---|---|---|
| WASHING PERFORMANCE | | |
| WASHABILITY RATIO | 1.1 | 0.86 |
| WASHING CAPACITY | 6.0 | 4.5 |
| WASHING TIME | 12 | 26 |
| RINSING PERFORMANCE | 16 | 16 |
| REMAINING ABS CON-CONCENTRATION (ppm) | | |
| DEHYDRATING PERFORMANCE | | |
| WATER-EXTRACTING EFFICIENCY (%) | 60 | 57–59 |
| TUB VIBRATION AMPLITUDE (mm) | 7.0 | 12–20 |
| CABINET VIBRATION AMPLITUDE (mm) | 2.1 | 2.5 |
| DRYING PERFORMANCE | | |
| DRYING EFFICIENCY (%) | 60 | 46–51 |
| DRYING TIME (min/kg) | 41 | 44–52 |

A method of the test is in accordance with Japanese Industrial Standard, JIS C 9606 and JIS C 9608. With regard to the temperature of the outer wall of the washtub, the inside of the drum and the cabinet, it was recognized that about 30° deg lower in this embodiment than in the prior art embodiment.

What is claimed is:

1. A washing/drying machine comprising:

a washtub;

means for feeding water to the washtub;

means for draining water from the washtub;

a tumbling drum, that includes a flat end wall, rotatably supported along a lateral axis in the washtub, the tumbling drum having a plurality of holes for the passage of air and water and an opening for introducing the washing, and a lid for closing the opening;

means for rotating the tumbling drum at various speeds;

a disc for agitating the washing, disposed in the drum adjacent to the flat end wall of the tumbling drum in parallel with the wall;

means for rotatably supporting the disc;

means for selectively fixing the disc;

means for supplying hot air to the tumbling drum; and means for controlling the fixing means to intermittently fix the disc in a stationary position as the tumbling drum rotates.

2. A washing/drying machine according to claim 1, wherein the disc supporting means comprises a bearing for rotatably supporting the disc along an axis and the fixing means comprises a clutch for mechanically engaging/disengaging the disc along an axis with/from the washtub.

3. A washing/drying machine according to claim 1, wherein the agitating disc includes a plurality of projections and a plurality of air holes.

4. A washing/drying machine according to claim 1, wherein the drum has a circular side wall with an annular rib in the periphery of the circular side wall.

5. A washing/drying machine according to claim 1, wherein the wash tub includes two flat end walls and the hot air supplying means includes a duct located outside the washtub, for communicating with both flat end walls of the washtub, a blower located in the duct for circulating the air in the washtub through the duct, and a heater located at an outlet end of the duct.

6. A washing/drying machine according to claim 5, wherein the heater is arched in shape and located on one of the end walls of the washtub and above the axis of the drum.

7. A washing/drying machine according to claim 6, wherein the heater is accommodated in an arched concavity provided on a side wall of a washtub and covered with a cover.

8. A washing/drying machine according to claim 6, wherein the heater is accommodated in a heater case attached to the side wall of the washtub.

9. A washing/drying machine according to claim 5, wherein the hot air supplying means further includes cooling means for once cooling air that circulates in the duct to dehumidify it.

10. A washing/drying machine according to claim 9, wherein the cooling means includes a U-shaped air duct.

11. A washing/drying machine according to claim 1, wherein the drum rotating means is a DC brushless motor composed of a stator provided with a winding and a rotor including a permanent magnet.

12. A washing/drying machine according to claim 11, further including means for supplying an ON-OFF duty ratio of line voltage to the winding of the stator in a first washing condition, where the motor works at high speed, which is larger than an ON-OFF duty ratio of a line voltage applied to the winding of the stator in a second washing condition, where the motor works at low speed, so that revolutions of the motor are controlled in accordance with the first or second washing conditions.

13. A washing/drying machine according to claim 12, wherein the line voltage applied to the winding of the stator of the motor is subjected to pulse width modulation in order to control the motor speed in a range of the washing conditions.

14. A washing/drying machine according to claim 1 wherein the means for controlling the fixing means includes a solenoid which when in an OFF condition, the disc will be stationary so that as the drum rotates, projections on the disc act so as to accomplish wash by friction and pressure caused by rubbing and crumpling.

15. A washing/drying machine according to claim 1 wherein the means for controlling the fixing means includes a solenoid which when in an ON condition, the disc will move independently of the drum in accordance with movement of the washing so that the washing is performed by beating.

* * * * *